US006142285A

United States Patent [19]

Panzeri et al.

[11] Patent Number: 6,142,285

[45] Date of Patent: Nov. 7, 2000

[54] COIN TESTING APPARATUS AND METHOD

[75] Inventors: Ezio Panzeri, Milan, Italy; Burhan Al-Hashemi, Dubai, United Arab Emirates

[73] Assignee: Digitall Inc, Dover, Del.

[21] Appl. No.: 09/166,114

[22] Filed: Oct. 5, 1998

[30] Foreign Application Priority Data

May 21, 1996 [GB] United Kingdom ..... 9610603
May 17, 1997 [WO] WIPO ..... PCTIB9700569

[51] Int. Cl.[7] ..... G07D 5/00; G07D 5/02

[52] U.S. Cl. ..... 194/328; 194/334

[58] Field of Search ..... 194/334, 335, 194/338, 331, 328, 330, 329

[56] References Cited

U.S. PATENT DOCUMENTS

| | | | |
|---|---|---|---|
| 5,346,049 | 9/1994 | Nakajima et al. | 194/328 |
| 5,542,520 | 8/1996 | Beisel et al. | 194/335 |

FOREIGN PATENT DOCUMENTS

| | | |
|---|---|---|
| 2 360 138 | 2/1978 | France . |
| 2 373 104 | 6/1978 | France . |
| 3414445 | 10/1985 | Germany . |
| 6060240 | 3/1994 | Japan . |
| 1 486 519 | 9/1977 | United Kingdom . |
| 1486519 | 9/1977 | United Kingdom . |
| 2 010 559 | 6/1979 | United Kingdom . |
| 2 212 313 | 7/1989 | United Kingdom . |
| 2 248 333 | 4/1992 | United Kingdom . |
| WO 88/07731 | 10/1988 | WIPO . |
| WO 90/14645 | 11/1990 | WIPO . |

*Primary Examiner*—Robert P. Olszewski
*Assistant Examiner*—Bryan Jaketic
*Attorney, Agent, or Firm*—Nixon & Vanderhye P.C.

[57] ABSTRACT

A method of coin testing is provided in which a laser beam (13) is directed onto a face of a coin (4) and a laser detector (3) is used to detect where the laser beam is intercepted by the coin and where the laser beam is not intercepted by the coin, so as to obtain an indication of a characteristic of the face of the coin. The characteristic of the coin is used to identify the coin. The invention also relates to an apparatus for coin testing, which comprises a laser source (11) to direct a laser beam (13) on a face of a coin (4), a laser detector (3) for detecting where the laser is intercepted by the coin and where the laser is not intercepted by the coin, and a signal-processor (14) which obtains an indication, from an output of the laser detector (3), of a characteristic of the face of the coin which is used to identify the coin.

66 Claims, 41 Drawing Sheets

COIN TESTING APPARATUS AND METHOD

The present invention relates to coin testing apparatus, and a method of recognizing coins.

Coin testing systems, or coin valuators, are used to recognise and evaluate different coins, for example, in vending machines and telephones. There are various electromechanical and electromagnetic coin valuators available which are in use for various purposes; e.g. vending machines, public and private telephones, etc. Such valuators may be used in many types of vending machine, or slot machine, in, for example, airports, railway stations, gambling machines, industries, schools, hospitals, hotels, or offshore platforms.

Such coin valuators in operation in vending machines and telephones are generally very limited as regards the number of different types of coin that can be evaluated.

British Published Patent Application GB-A-2,212,313 discloses a coin sorting apparatus in which a beam of light is directed at an angle towards the edge of a coin. If the coin is of the right diameter, then part of the beam of light passes in a straight line through to a first detector and part of the beam of lights is reflected (scattered) to a second detector that is not on the straight through path. The system of GB-A-2,212,313 relies upon some light being received by both detectors to identify that the coin is of just the right diameter to partially reflect the light beam. If no light is received by either detector, or all of the light is received by the straight through detector, then the coin is not of the desired diameter. The system suggests a laser diode as one possible light source.

European Published Patent Application EP-A-0,629,979 discloses a system ensuring that a supply of new coins have the correct size by using a light current and a linear sensor array.

SUMMARY OF THE INVENTION

According to a first aspect of the present invention, there is provided a method of coin testing, in which a laser beam is directed onto a face of a coin and a laser detector is used to obtain an indication of a dimensional characteristic of the face of the coin, characterised in that said laser detector detects where the laser beam is intercepted by the coin and where the laser beam is not intercepted by the coin.

The length may be determined or detected of at least part of at least one elongate strip of the face of the coin.

The lengths may be determined or detected of at least parts of a plurality of elongate strips of the face of the coin.

The beam may scan the strips, or the parts thereof, one after another.

The beam may have a fan-like shape so as to impinge upon the whole of the or each said strip, or part thereof, simultaneously.

The laser detector may comprise many side-by-side pixels, each individually capable of detecting laser radiation.

Preferably, the beam is stationary and the coin moves past the beam.

The coin may rotate as it moves past the beam.

The coin may move along a guide as it moves past the beam.

The coin may be in free fall as it passes the beam.

On end of the or each said strip may be at an edge of the coin and another end of the strip may be at a predetermined location which is not at an edge of the coin.

A second laser beam may be directed at an edge of the coin and may be detected so as to determine a characteristic of the edge and/or thickness of the coin.

A dimensional characteristic of a groove and/or a ridge on the edge of the coin may be determined or detected.

The number of grooves and/or ridges in a predetermined distance on the edge of the coin may be counted.

The second laser beam may be derived from the first-mentioned laser beam.

The second laser beam may be derived from the first-mentioned laser beam by means of a prism which redirects a portion of the first-mentioned laser beam.

Preferably, at the point of interception of the coin and the laser, the coin is absolutely perpendicular to the laser beam.

At the point of interception of the coin and the laser, the laser beam may be substantially in the form of a thin plane of laser radiation.

According to a second aspect of the present invention, there is provided apparatus for coin testing, comprising a laser source adapted and arranged to direct a laser beam onto a face of a coin.

a laser detector, and a signal-processor adapted and arranged to obtain from an output of the laser detector an indication of a dimensional characteristic of the face of the coin; characterised in that said laser detector adapted and arranged to detect where the laser is intercepted by the coin and where the laser is not intercepted by the coin Preferably, the apparatus is adapted to determine or detect the length of at least part of at least on elongate strip of the face of the coin.

The apparatus may be adapted to determine or detect the lengths of at least parts of a plurality of elongate strips of the face of the coin.

The beam may be adapted to scan said strips, or said parts thereof, one after another.

The beam may have a fan-like shape so as to impinge upon the whole of the or each said strip, or part thereof, simultaneously.

Preferably, the laser source and hence the beam are stationary and the apparatus is adapted to cause the coin to move past the beam.

The apparatus may comprise a guide for the coin to move along as it moves past the beam.

The apparatus may be adapted so that, in use, the coin is in free fall as it passes the beam.

In use, one end of the or each said strip may be at an edge of the coin and another end of the strip may be at a predetermined location which is not an edge of the coin.

The apparatus may comprise means to direct a second laser beam at an edge of the coin, means to detect where the second beam is intercepted by the coin, and means to determine therefrom a characteristic of the edge and/or thickness of the coin.

The apparatus may comprise means to derive the second laser beam from the first-mentioned laser beam.

The means to derive the second laser beam from the first-mentioned laser beam may comprise a prism which redirects a portion of the first-mentioned laser beam.

The laser detector may comprise may side-by-side pixels, each individually capable of detecting laser radiation.

According to a third aspect of the invention, there is provided a coin testing apparatus comprising:

a laser source adapted and arranged to direct a laser beam onto a coin;

a laser detector adapted and arranged to detect where the laser is intercepted by the coin and where the laser is not intercepted by the coin;

a coin guide arranged to enable the coin to travel along a specified path along which path the coin is able to intercept a portion of a laser beam passing between the laser source and the laser detector; and a signal-processor adapted and arranged to obtain an output of the laser detector;

wherein the proportion of the laser beam that is intercepted provides at least one measure of a geometric dimension of the coin, the coin being recognisable by comparing said measure of the coin with corresponding measures of a number of known coins.

At lest one measure may be made of a geometric dimension of the face of said coin and another measure may be made of the thickness of said coin in order to compare said measures of the face and thickness with corresponding measures of said number of known coins.

A range of geometric dimensions may be measured iteratively to provide an integrated area measurement of a surface region of said coin, said coin may be recognisable by comparing said area measurement of said coin with corresponding area measurements of said number of known coins.

A dimensional characteristic of a groove and/or a ridge on the edge of the coin may be determined or detected.

The number of grooves and/or ridges in a predetermined distance on the edge of the coin may be counted.

The measure of a geometric dimension of said coin, and said corresponding measures of said number of known coins, may all relate to measurements of coins which are smaller than the diameter or, in the case of irregular-shaped coins, the maximum cross-section of each respective coin.

The laser beam passing between said laser source and said laser detector may travel therebetween via a circuitous non-direct route.

The laser beam may be directed along said circuitous non-direct route by one or more of mirrors or prisms.

The path may comprise a passageway, having a lower boundary, along which said coin is able to travel through the apparatus whilst supported continuously at its peripheral edge by said lower boundary of said passageway.

The laser source may be mounted so as to direct a laser beam from one side to the other of a portion of said passageway, substantially perpendicularly to the main plane of said coin in said passageway, so as to be intercepted by upper regions of said coin as it travels through said portion of said passageway.

The laser detector may comprise a linear array of many side-by-side pixels, each individually capable of detecting laser radiation.

The array may extend substantially parallel to said main plane, and transversely with respect to the direction of travel said coin along said portion of the passageway, and may have a lower end spaced at a first distance from said lower boundary, which first distance is less than the minimum diameter of said number of coins, and an upper end spaced at a second distance from said lower boundary, which second distance is greater than the maximum diameter of said number of coins, said laser detector may be operable to produce an output dependent upon the number of said pixels from which said laser beam is blocked, at a plurality of successive sampling instants, by a coin travelling along said portion of the passageway, so that said output can be compared with predetermined reference data records to ascertain which of those records corresponds to said output.

The coin may travel along said path such that at the point of interception said coin is absolutely perpendicular to said laser beam.

Preferably, the laser beam that is intercepted by said coin is, at the point of interception, substantially in the form of a thin plane of laser radiation.

According to a fourth aspect of the invention, there is provided coin testing apparatus comprising:

a coin guide defining a coin passageway, having a lower boundary, along which a coin can travel through the apparatus whilst supported continuously at its peripheral edge by said lower boundary;

a laser source being mounted for directing a laser beam from one side to the other of a portion of said passageway, substantially perpendicularly to the main plane of a coin in the passageway, so as to be intercepted by upper regions of said coin as it travels through said portion of said passageway; and laser detector comprising, at said other side of said portion of the passageway, a linear array of laser receiving locations, which array extends substantially parallel to said main plane, and transversely with respect to the direction of travel of the coin along said portion of the passageway, and has a lower end spaced at a first distance from said lower boundary, which first distance is less than the minimum diameter of a number of coins with which the apparatus is to be used, and an upper end spaced at a second distance from said lower boundary, which second distance is greater than the maximum diameter of said number of coins, said laser detecting means being operable to produce an output dependent upon the number of said laser-receiving locations from which said laser beam is blocked, at a plurality of successive sampling instants, by a coin travelling along said portion of the passageway, so that said output can be compared with predetermined reference data records to ascertain which of those records corresponds to said output.

The apparatus may comprise more than one laser source and more than one laser detector.

According to a fifth aspect of the invention, there is provided a method of recognising a coin comprising the steps of:

i) making a coin travel along a specified path such that said coin intercepts a portion of laser beam passing between a laser radiation source and a laser detector;

ii) measuring the proportion of said laser beam that is intercepted as a means of ascertaining at least one measure of a geometric dimension of said coin, iii) comparing said measure of said coin with the corresponding measure of a number of known coins in order to recognise said coin.

The at least one measure may be made of a geometric dimension on the face of said coin; and the method may further comprise the step of ascertaining the measure of the thickness of said coin in order to compare said measures with corresponding measures of said number of know coins.

The method may further comprise the step of ascertaining the measure of a number of geometric dimension of said coin to provide an integrated area measurement of a surface region of said coin, said coin being recognisable by comparing said area measurement of said coin with the corresponding area measurements of said number of known coins.

The method may comprise the step of determining of detecting a dimensional characteristic of a groove and/or a ridge on the edge of the coin.

The method may further comprise the step of counting the number of grooves and/or ridges in a predetermined distance on said coin.

In this description and the appended claims, the terms "laser source" and "laser detector" should be taken to cover any device or combination of devices which fulfil the function of providing a source of laser radiation, and detecting the laser radiation, respectively. The laser source and laser detector may each be a single component a part of a component, or an assembly of parts, provided that each fulfils the function of enabling the working of the invention as claimed.

Further preferred features of the invention will be apparent from the claims annexed hereto and the subject matter of these claims are hereby imported into this specification.

In order that the invention might be more fully understood, embodiments of the invention will be described, by way of example only, with reference to the accompanying drawings, in which.

Figure 1:
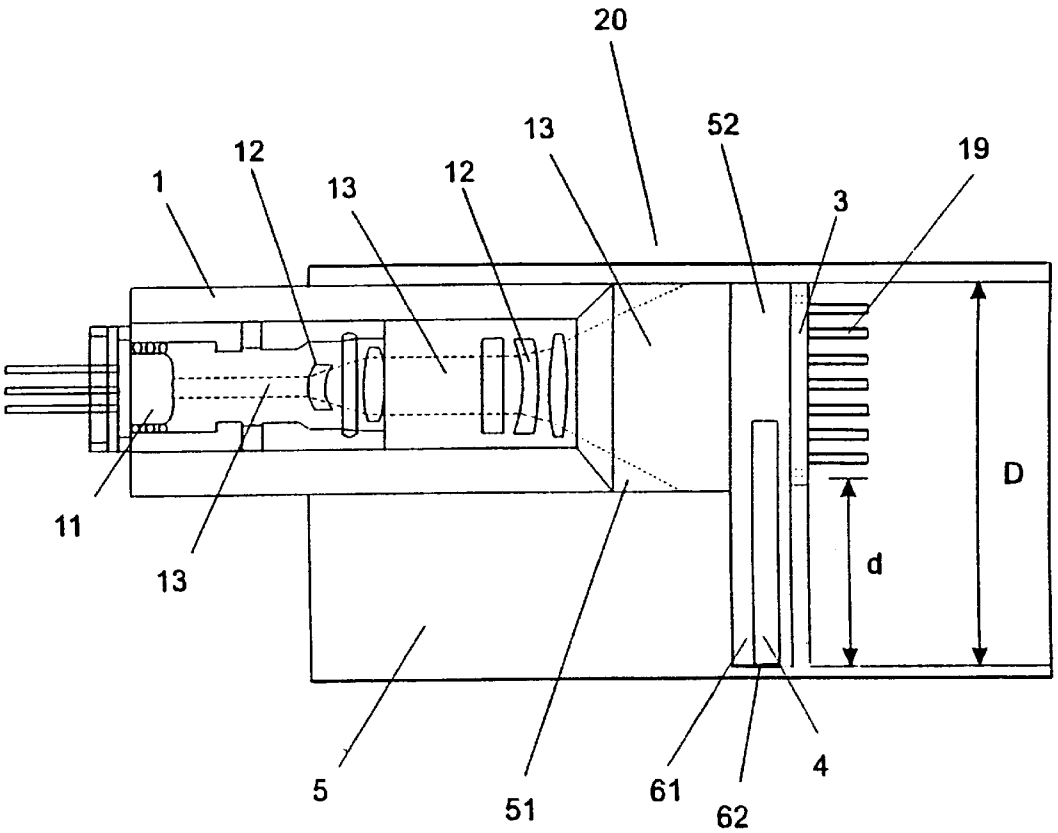
FIG. 1 shows a cross-sectional side view of a first embodiment of a coin testing apparatus.
Figure 1A:
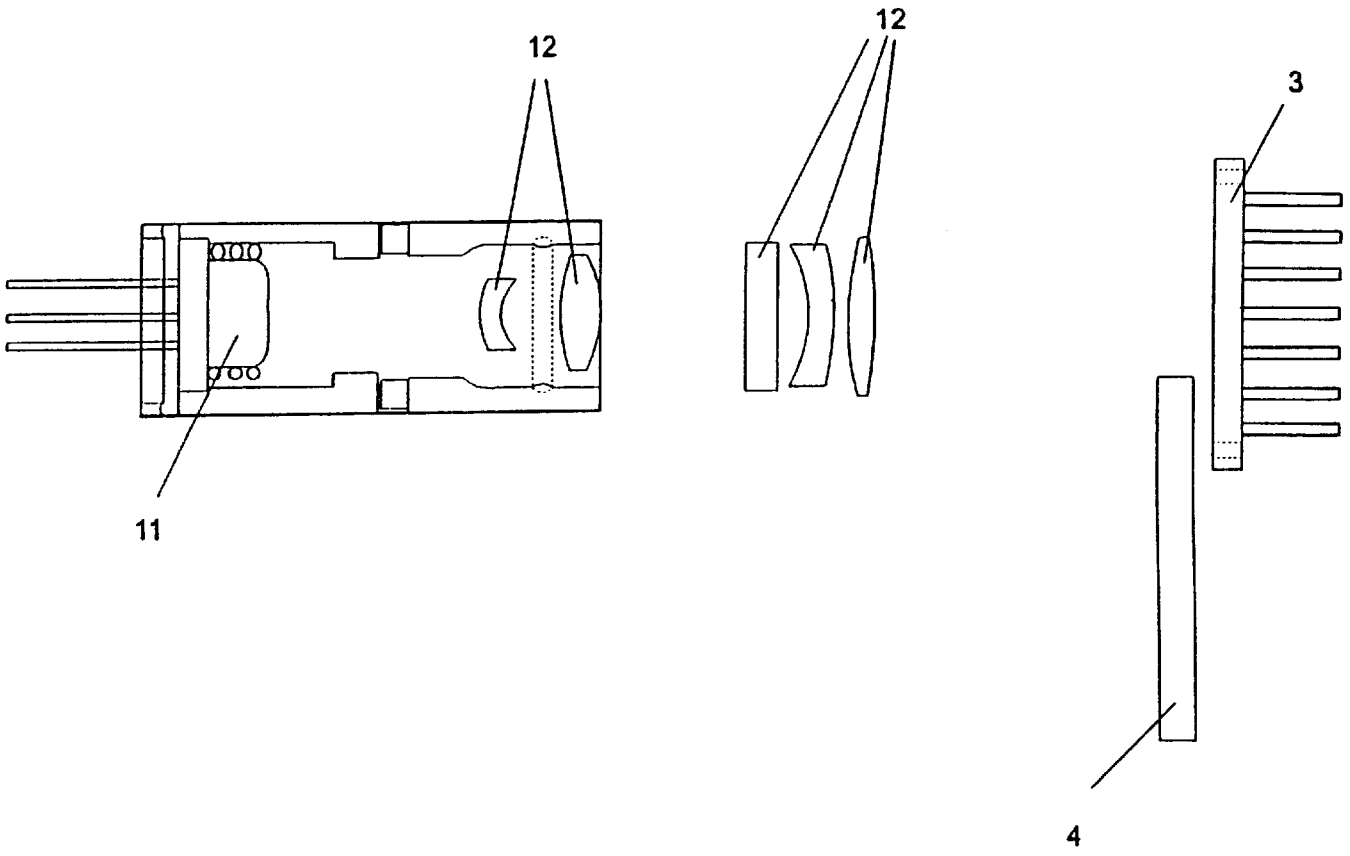
FIG. 1A shows components of the first embodiment in their relative orientation to one another.
Figure 1B:
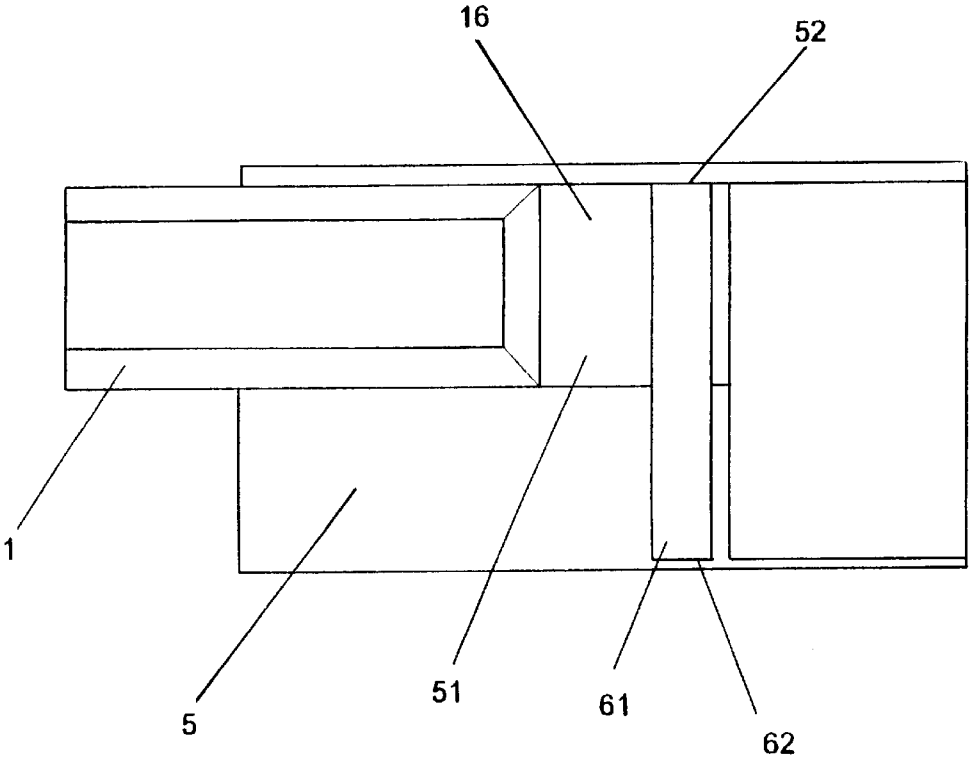
FIG. 1B shows a cross-sectional side view of a housing used in the embodiment of FIG. 1 without the internal components, for the sake of illustration.

The drawings are provided for the purpose of illustration only and therefore are not necessarily drawn to scale.

In the embodiments, similar components are numbered with the same numbers for the sake of illustration. For example, the laser radiation sources in each embodiment would be labelled with the same reference numeral, but this should not be taken to imply that the embodiments are identical.

DESCRIPTION OF EMBODIMENTS

First Embodiment

Referring to FIG. 1, there is illustrated a first embodiment of the invention, in the form of a coin testing apparatus 20. The apparatus 20 comprises a housing 5.

A laser in the form of a cylindrical laser unit 1 is slideably mounted in a cylindrical cavity 51 in the housing 5.

The laser unit 1 comprises a conventional laser diode 11 and lens groups (both groups indicated by the numeral 12.) The laser diode 11 produces a laser beam 13 (shown with dotted lines in FIG. 1). The lens groups 12 are designed to convert the laser beam 13 into a form such that the beam is in a fan-like shape when it leaves the front of the laser unit 1. The laser beam emanates from the laser diode 11 as a point source, and is spread into a fan-like shape by the lens groups 12 so that the beam can be used to impinge upon larger portions of the coin simultaneously.

The shape of the laser beam 13 is one that spreads in the form of a fan-like laser beam. In order to create this flat spreading laser beam, two sets of lenses of differing characteristics are use. A first group of lenses 12 act to highly collimate the laser beam having a rectangular cross-section. Another group of cylindrical lenses 12 causes the cross-section of the laser beam to be elongated, such that the cross-section becomes an elongated rectangle, almost to the point of being a line. The laser beam 13 from the laser diode 11 passes through these lenses. In FIG. 1, the fan-like laser beam is focused using lenses 12 in the laser unit 1, and by slideably adjusting the position of the laser unit 1 in the cavity 51.

The coin testing apparatus 20 further comprises a coin guide which includes a channel 61 having a lower boundary 62 and an upper passageway 52, in which there is shown a coin 4. The coin is introduced to the passageway 52 by way of a coin insertion aperture 62 (best seen in FIG. 1D). The channel 61 guides the coin 4 along the passageway. The coin passageway 52 extends transversely through the housing member 5. The coin 4 is supported continuously at its peripheral edge by the lower boundary 62 of the coin guide. The coin 4 travels through the apparatus in a direction perpendicular to the plane of FIG. 1.

On the far side of the channel 61 from the laser source 11, the housing 5 contains a laser detector in the form of a sensor array unit 3. The array unit 3 comprises many side-by-side individual high speed charge accumulators and pixels (not separately shown). These charge accumulators include pixels which are sensitive to laser radiation and are capable of detecting and measuring laser radiation energy levels. The pixels are arranged in a linear array, in a linear or grid-like orientation to form a contiguous array of pixels. Each charge accumulator, in its uncharged state, is able to become charged when the beam of a laser beam 13 shines on the particular pixel. The pixels are sufficiently sensitive to detect photons, which are an elementary component of the laser beam. The sensor array unit 3 also comprises pins 19 which are adapted to connect the sensor array unit 3 to an electronic circuit, described hereinafter.

The laser beam 13, generated by the laser diode 11, is directed towards the sensor array unit 3. In the embodiment of FIG. 1, after the laser beam leaves the laser diode 11, the laser beam 13 is directed to form a fan-like flat beam shape. The reference to fan-like refers to the spreading of the laser beam as it leaves the laser diode. The reference to the flat beam refers to the formation of a thin line, or linear plane of laser beam radiation. The plane of this fan-like beam of radiation is generally directed towards the centre of the linear array.

The laser beam 13 travels between the laser diode 11 and the linear array of sensors 3. The laser beam 13 is directed axially along the cavity 51 and across the passageway 52. The axis of this laser beam 13 is substantially perpendicular to the main plane of the coin in the passageway. The laser beam 13 is directed onto a face of the coin 4 to be tested. The coin 4 intercepts a portion of this laser beam 13 that passes between the laser diode 11 and the sensor array unit 3. In the present embodiment, the beam is stationary and the coin moves past the laser beam. A circular coin rotates as it moves past the beam, while a non-circular or polygonal-shaped coin would slide past the beam.

The sensor array 3 is able to detect where the laser is intercepted by the coin and where the laser is not intercepted by the coin, since those pixels which are irradiated by the laser beam will cause the charge accumulators to become charged, while those pixels that are shielded by the coin will not cause the charge accumulators to be charged. The information of the charged and uncharged accumulators is used to obtain an indication of a characteristic of the face of the coin, as will be described below.

Figure 9:
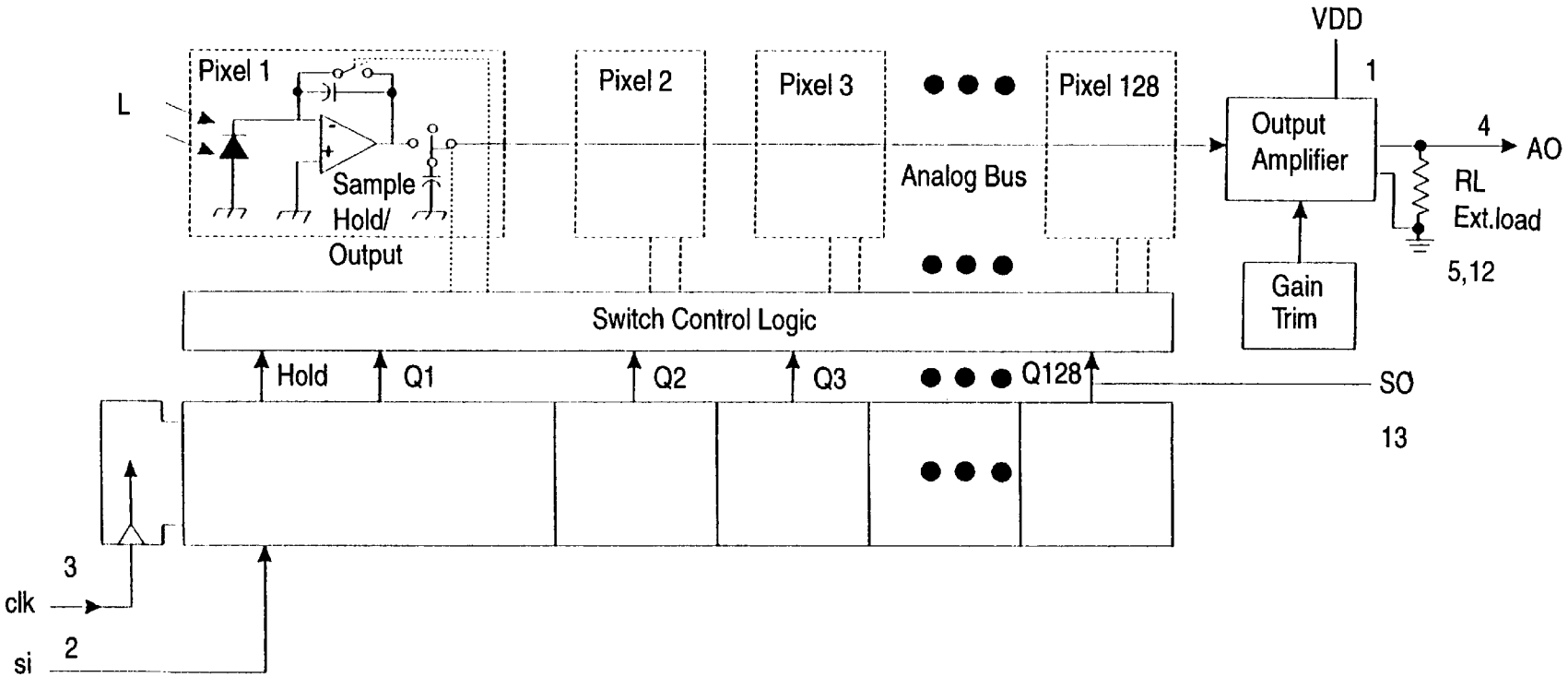
FIG. 9 shows an electrical block diagram of internal parts of the sensor unit shown in FIG. 8.

Referring to FIG. 9, the pixels and charge accumulators work on the basis of saturation by measuring the minimum and maximum absorbable quantum energy of the laser beam. When a pixel is excited to the level of around half of its maximum saturation charge, the control logic of the pixel is able to determine the accurate amount of energy received by the pixel from the laser beam. The control logic then determines whether to consider the charge accumulator as being "0" for an uncharged state, or "1" for a charged state.

In the present embodiment, the plane of the linear sensor array unit 3 extends substantially parallel to the main plane of the coin 4 in the passageway 52, and transversely with respect to the direction of travel of the coin along the passageway. In FIG. 1, the lower end of the array 3 is spaced at a first distance d from the lower boundary 62, which first distance d is less than the minimum diameter of any coin with which the apparatus is to be used. The upper end of the array 3 is spaced at a second distance D from the lower boundary 62, which second distance D is greater than the maximum diameter of any coins. The laser beam 13 will therefore be intercepted by upper regions of the coin 4 as it travels along the passageway.

It is preferable to allow upper regions of the coin 4 to be intercepted by the laser beam 13 to allow measurements to be taken of upper regions of the coin. Alternatively, measurements may be taken at other regions of the coin 4, such as side portions. However, when the coin is in contact with the lower boundary 62 of the coin guide, such contact would make it difficult to obtain accurate measurements for those parts of the coin which are in contact with the lower boundary 62.

Measurements of the coin need not be taken for the entire diameter or, in the case of irregular coins, the maximum cross-section. By avoiding readings of the diameter or maximum cross-section, the problems associated with measuring the portion where the coin contacts the rolling surface are minimised.

The sensor unit of the linear array 3 produces electrical outputs, at respective successive sampling instants, which are dependent upon the number of the pixels which are blocked by the coin and the number of pixels which are not blocked. This signal is preferably sampled many times as the coin moves past the linear array 3, as will be described in more detail below.

Figure 12:
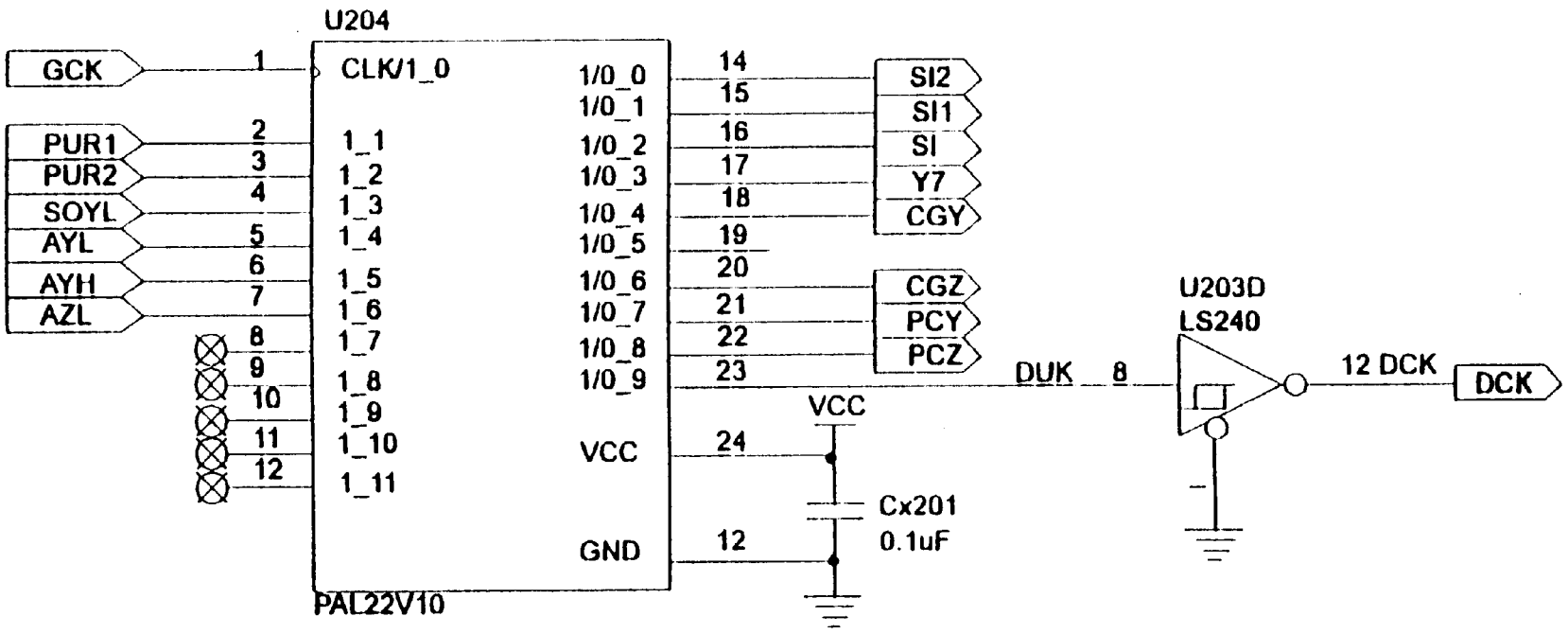
FIG. 12 shows a block circuit diagram of a counter circuit used in the embodiments of FIGS. 1 and 2.
Figure 12A:
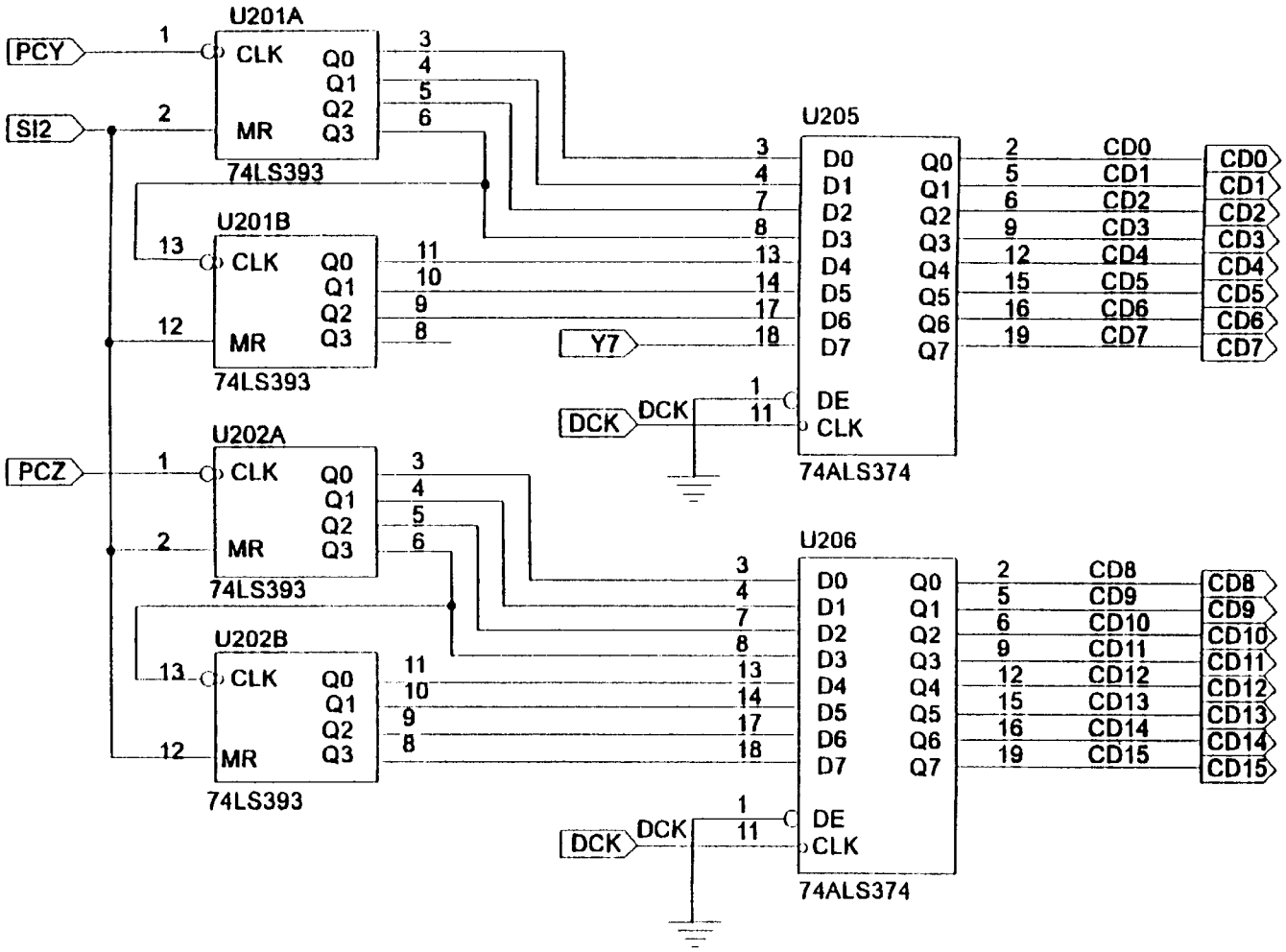
FIG. 12A shows two circuits of latches.
Figure 12B:
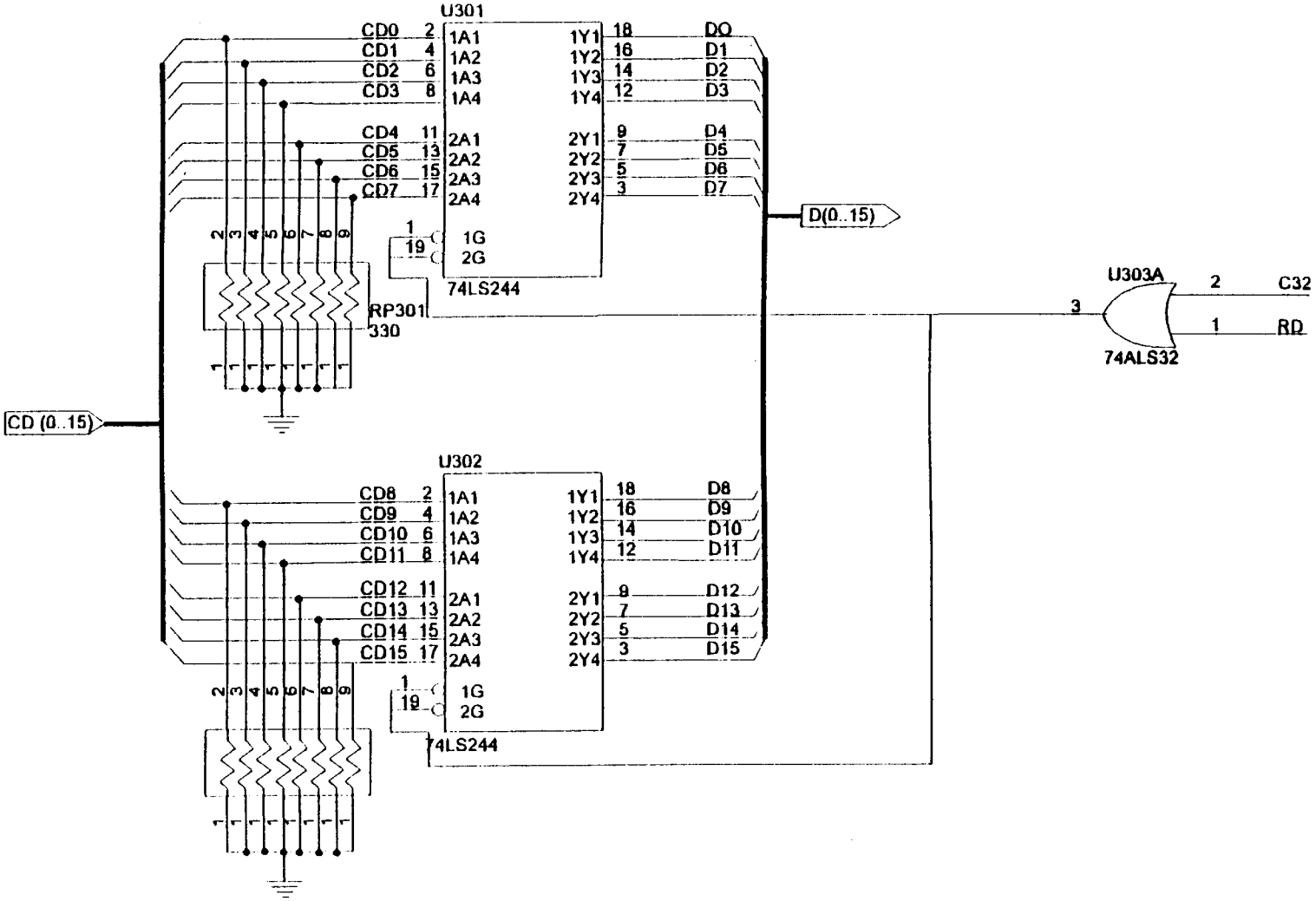
FIG. 12B show a block circuit diagram of two buffer interfaces.
Figure 12C:
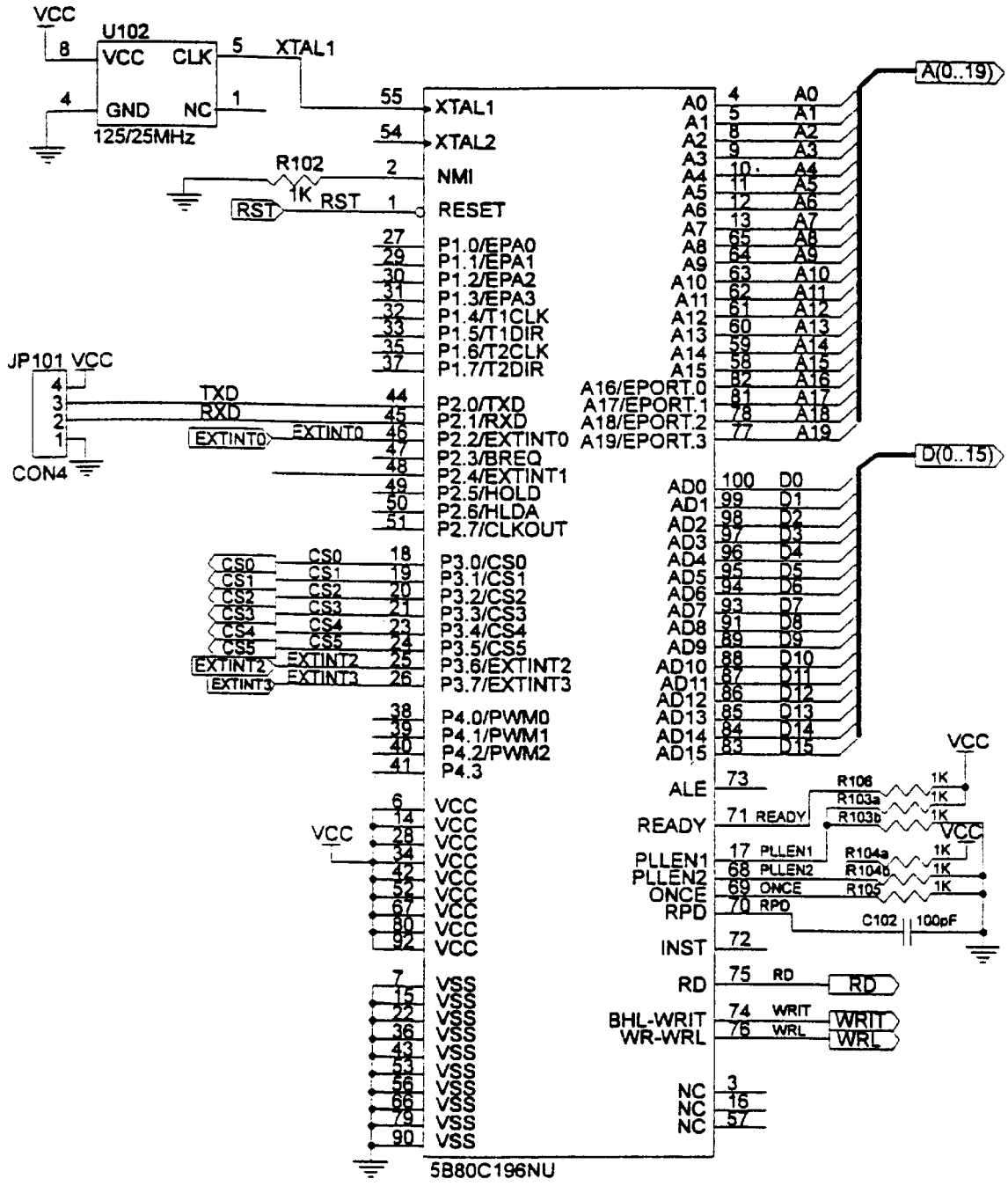
FIG. 12C shows a block circuit diagram of a main control circuit used in the embodiments of FIGS. 1 and 2.
Figure 14:
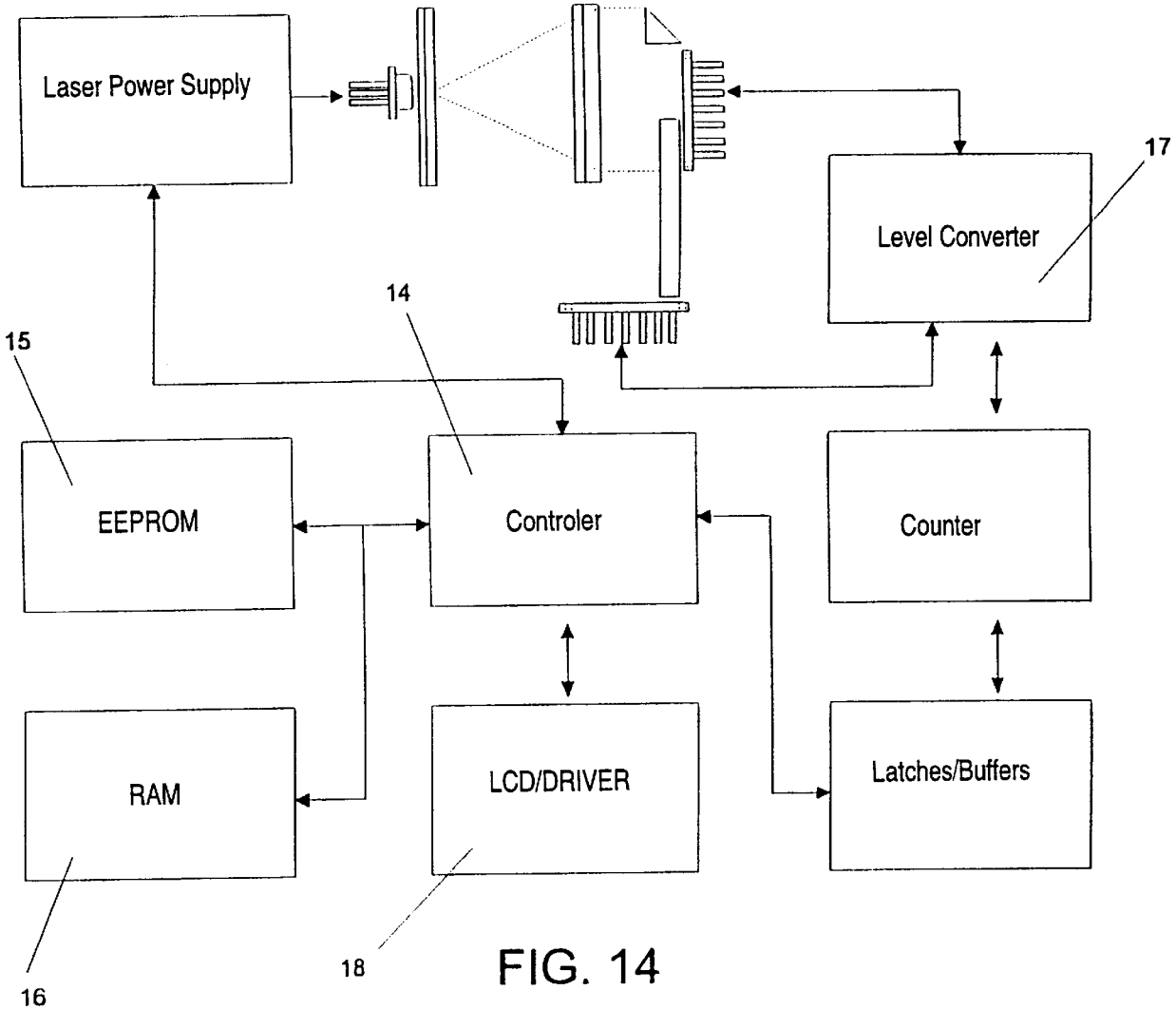
FIG. 14 is a block diagram illustrating components embodiments of the invention with respect to the electrical components.

The sensor unit of the linear array 3 is connected to a signal processor which process these outputs to identify the coin concerned. The signal processor is in the form of microcontroller 14, which is illustrated in FIGS. 12C and 14. The microcontroller 14 includes comparison means for determining which, if any, of a plurality of predetermined reference data records correspond to the processed outputs. For example, the processed outputs from the linear array 3 are compared with data records of a large number of known coins. The coin 4 is identified by matching the processed output obtained from the linear sensor with the corresponding data record of the known coin.

Figure 1C:
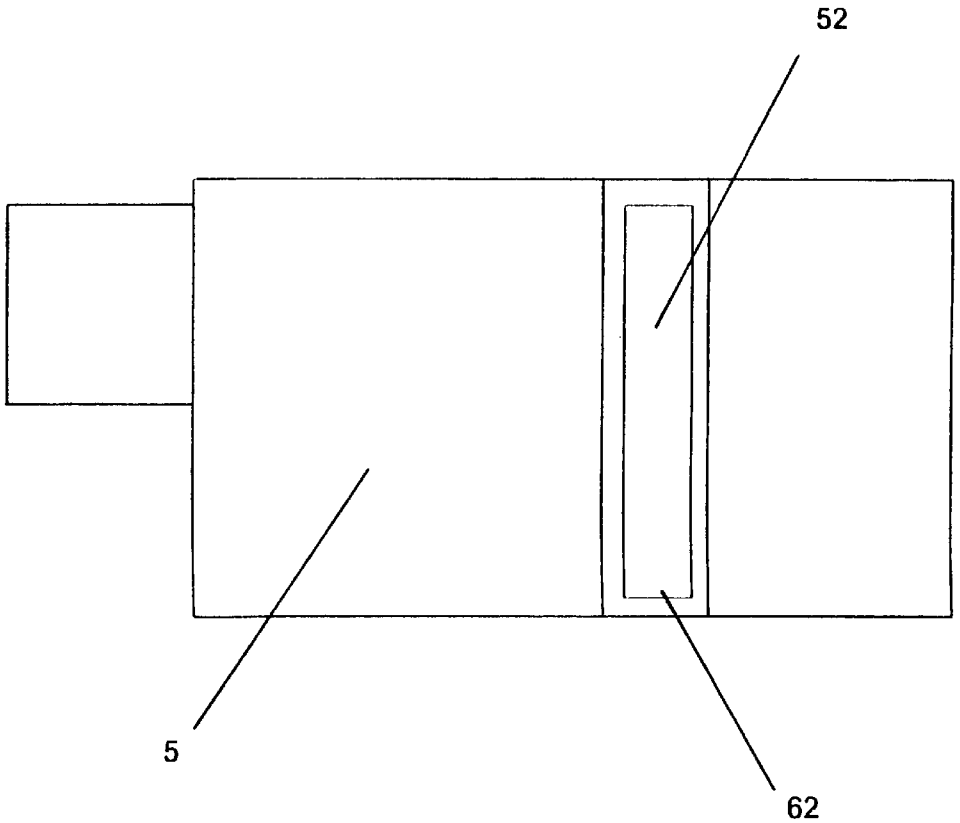
FIG. 1C shows an external side view of the housing of FIG. 1B.
Figure 1D:
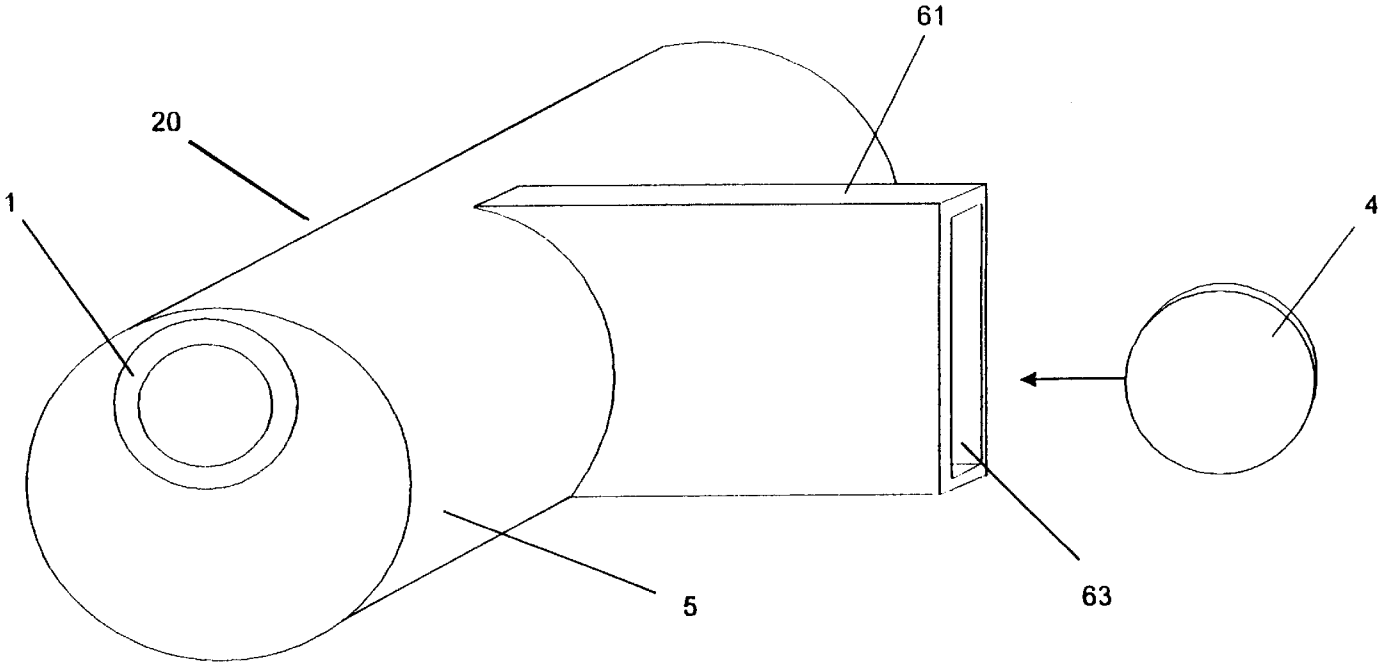
FIG. 1D shows a perspective view of the housing of FIG. 1B

The housing member 5 is made of a material which gives good absorption of scattered laser radiation, for example a black polycarbonate material. The external aspect of the housing 5 is illustrated in FIGS. 1C and 1D. Other designs may be selected depending on the particular environments in which they are installed. Moreover, in other embodiments of the invention, rather than the coin testing apparatus being installed in its own housing, it is possible for various components of the coin testing apparatus to be manufactured integrally as part of the device in which it is being used, for example, a vending machine or telephone. In these embodiments, the coin guide are provided as part of the components of the particular device. It is conceivable that the coin guide may not be a separately identifiable component. In such embodiments, any feature of the overall device that serves to guide the coin to be intercepted by the laser beam may be regarded as fulfilling the function of the coin guide.

In other embodiments, the various structural components of the coin testing apparatus may be moulded in one piece. For instance, mirrors and prisms may be moulded from the same material as the housing and coin guide. One advantage of moulding as a means of manufacture would be used to reduce the cost of apparatus.

Figure 7:
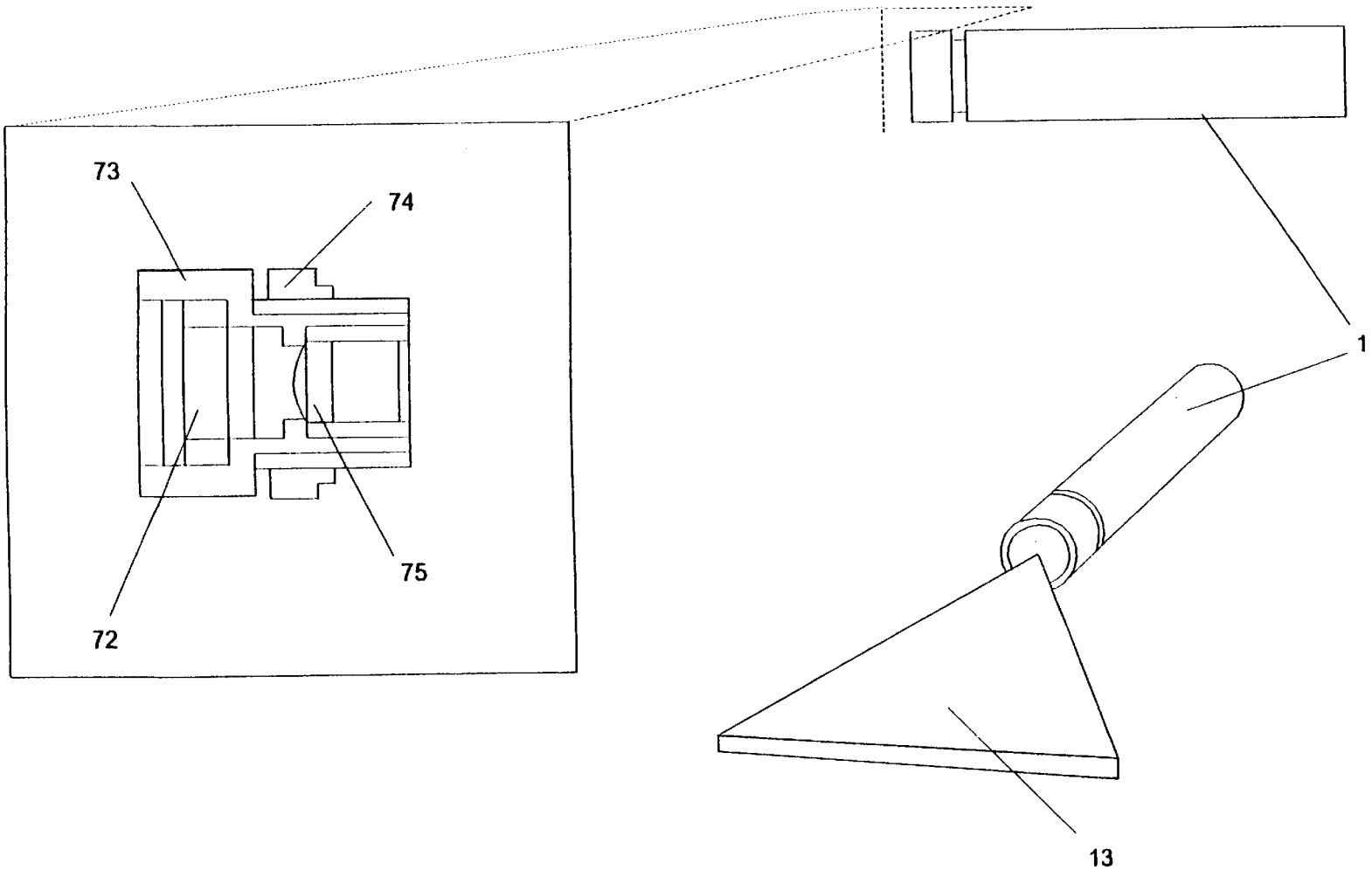
FIG. 7 shows a laser unit used in the first embodiment of FIG. 1.

FIG. 7 shows an alternative embodiment for constructing the lens groups. The desired shape of the laser beam 13 is produced by using a collimating lens 75 and a line generating lens 72 through which the laser beam from the laser diode passes. The fan-like beam is focused using the second series of lenses 12 in the laser unit 1, and by adjusting the axial position of the laser unit 1 in the cavity 51. By rotating a front cell assembly 73, the beam is focused and collimated, as illustrated in FIG. 7. A locking ring 74 is used to secure the final position. The lens assembly may be rotated using a key supplied with the laser diode module in order to produce the best line of incidence of the laser beam 13 on the linear array 3. The greater the operating distance, the longer and thicker the line.

Second Embodiment

Figure 2:
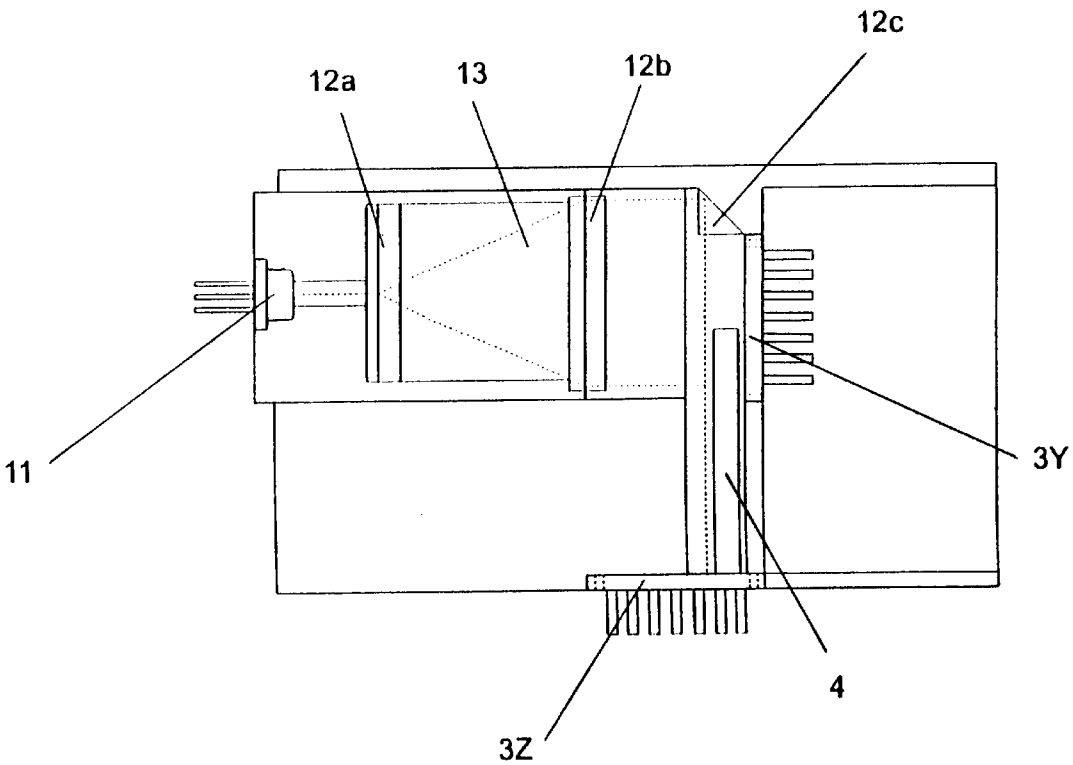
FIG. 2 shows a cross-sectional side view of a second embodiment of a coin testing apparatus.
Figure 2A:
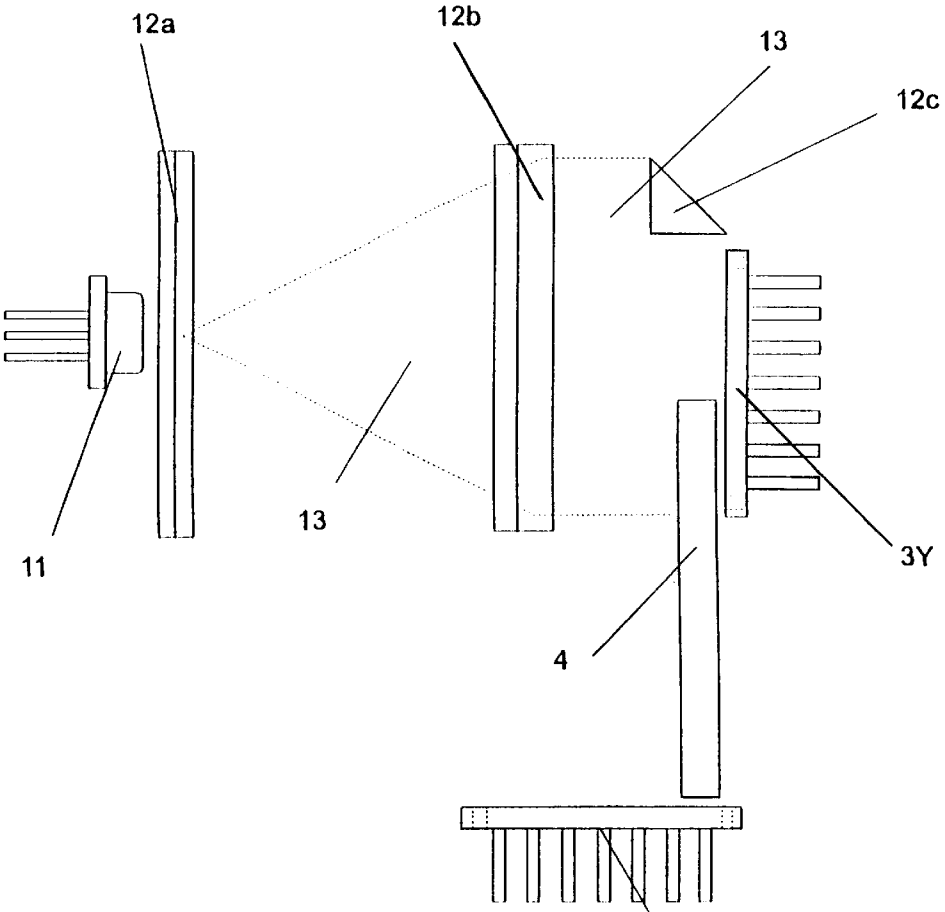
FIG. 2A shows components of the coin testing apparatus of the second embodiment of FIG. 2 in their relative orientation to one another.
Figure 2B:
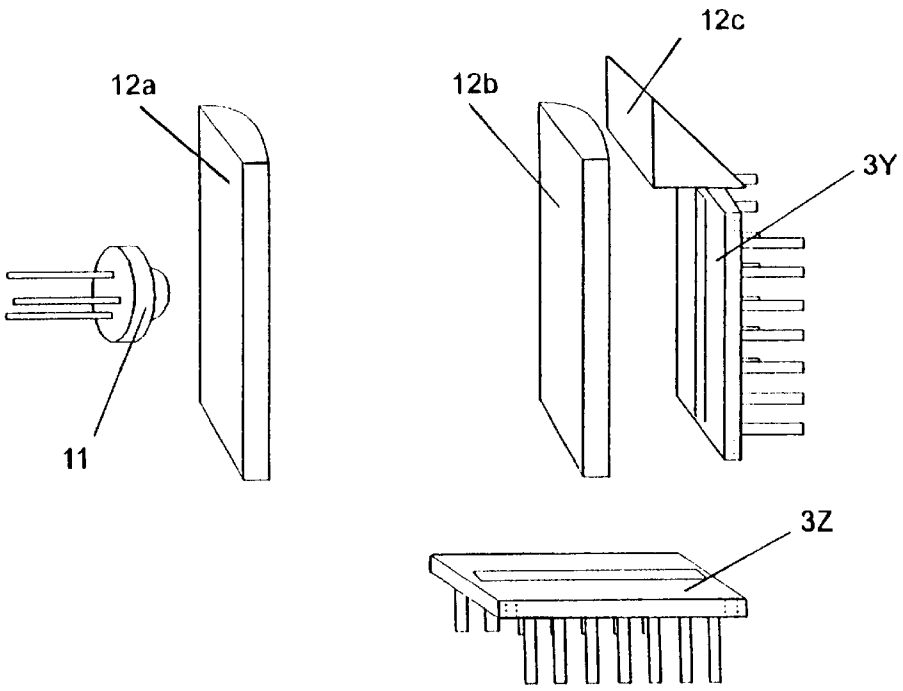
FIG. 2B is a perspective three-dimensional view of components of the second embodiment illustrated in FIGS. 2 and 2A.

A second embodiment of the invention is illustrated in FIGS. 2, 2A and 2B. This second embodiment is similar to the first embodiment, except that the laser detector comprises two linear arrays 3Y, 3Z. (For the sake of illustration of the concepts herein, X and Y refer to the orthogonal x and y axes terminology used in engineering.)

A laser beam 13 emanates from the laser diode 11 and is refracted by leans 12*a*, and further refracted by lens 12*b*.

Figure 7A:
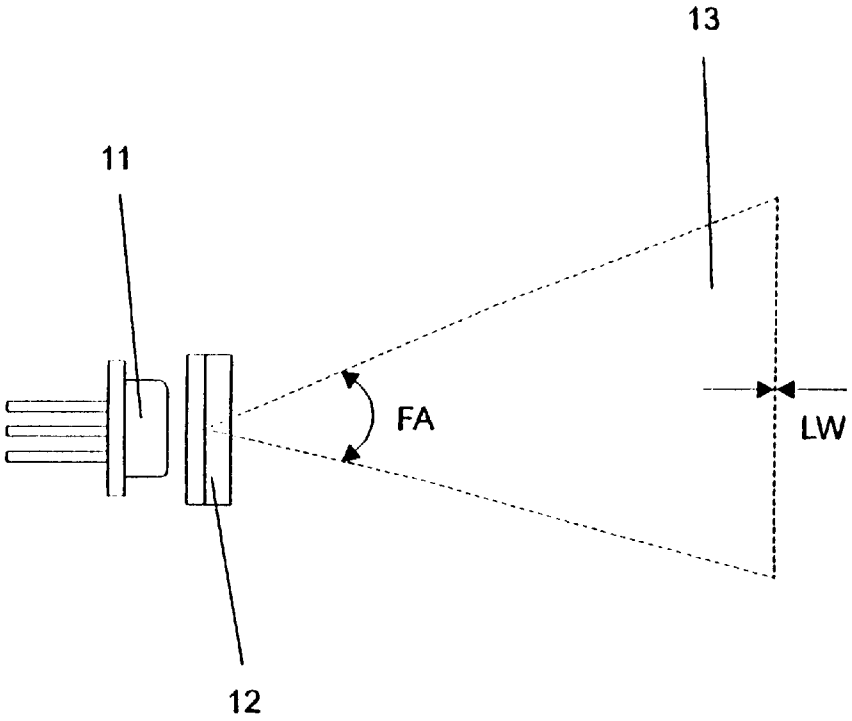
FIG. 7A shows the use of a Powell lens to focus the laser beam.
Figure 7B:
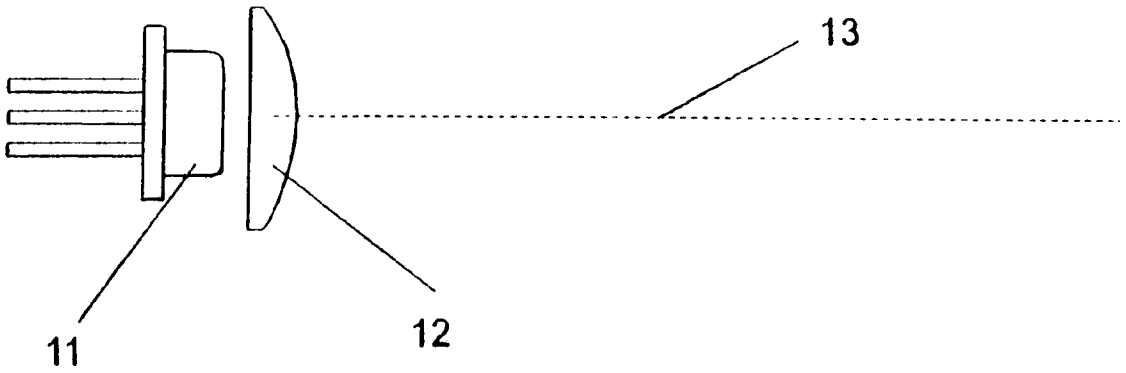
FIG. 7B shows to top view of the laser beam of FIG. 7A, illustrating that the laser beam formed by the Powell lens is in the form of a plane or line of laser radiation.

The focusing of the laser beam into a line is achieved using a "Powell lens". Lines of laser radiation focused by Powell lenses have the unique characteristic of having uniform intensity along the length of the line. The spreading effect of the laser beam is illustrated in FIG. 7. FIG. 7A shows the use of a Powell lens 12 for widening the angle of the laser beam 13. FIG. 7B is a top view of the laser beam shown in FIG. 7A which illustrates that the laser beam, formed by the Powell lens, is in the form of a thin plane of laser radiation.

Figure 2C:
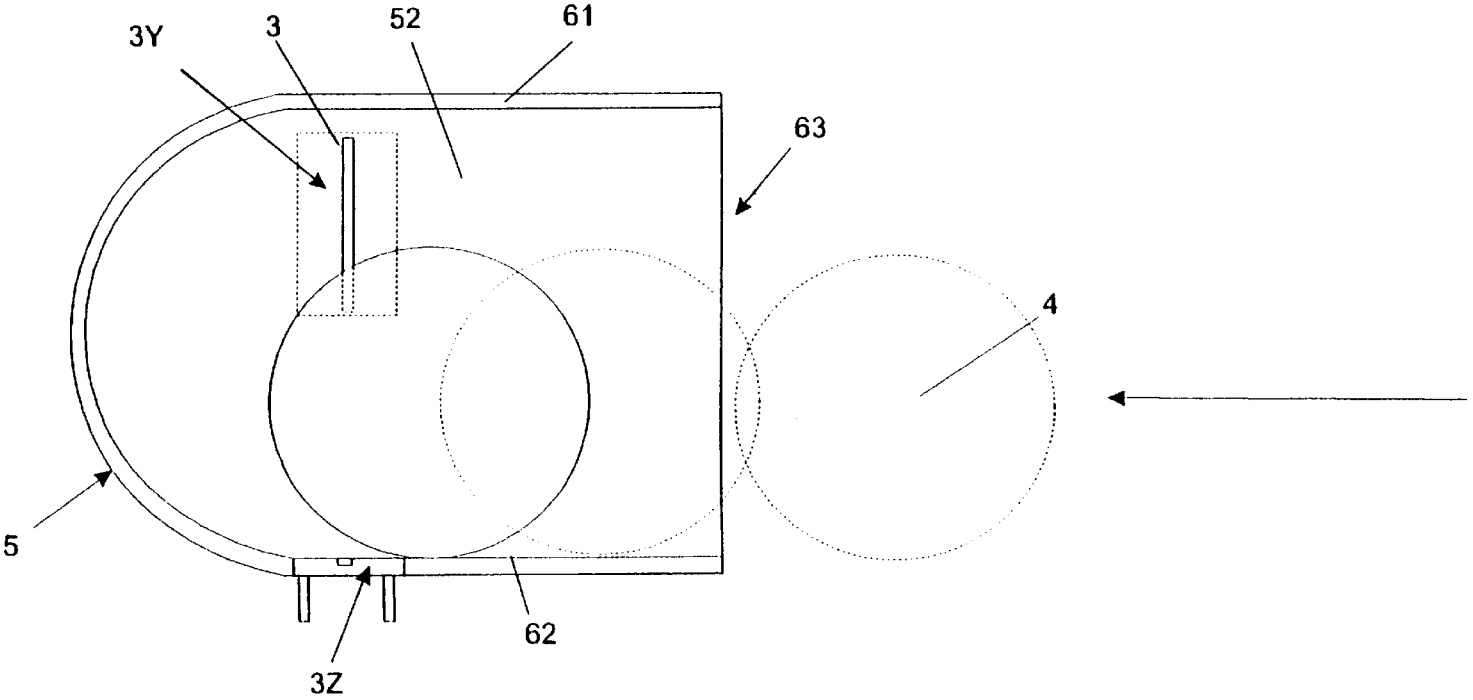
FIG. 2C shows another view of the second embodiment of FIGS. 2, 2A and 2B, illustrated with a coin shown as rolling from right to left across the diagram.

By the time the laser beam reaches the point of interception with coin 4, the laser beam 13 is directed along a path substantially perpendicular to the main plane of the coin 4. A portion of the laser beam is directed at an edge of the coin 4 and is intercepted by the circumferential rim or edge of the coin 4. Part of the remainder of the laser beam strikes linear array 3Y. Thus, the linear array 3Y is able to determine a characteristic of the edge and/or thickness of the coin 4. FIG. 2C illustrates a side view of the coin 4 rolling past the linear arrays 3Y, 3Z.

At the same time, a portion of laser beam 13 is re-directed by a prism 12*c*. Mirrors may be used instead of prisms. The prisms 12*c* re-directs the beam perpendicularly such that the beam is directed to strike the edge of the coin. Only a portion of downwardly directed beam strikes the other linear array 32. Thus, two linear arrays are used to measure different portions of the surface and edge of the coin 4.

An advantage of the beam being absolutely or at least substantially perpendicular to the main plane of the coin 4, at the critical point of interception of the coin with the beam, is that the beam subsequently shines directly onto the linear sensor without any further deviation. Hence, the measurement taken at the linear sensor would be an accurate measure of the actual coin.

Figure 4:
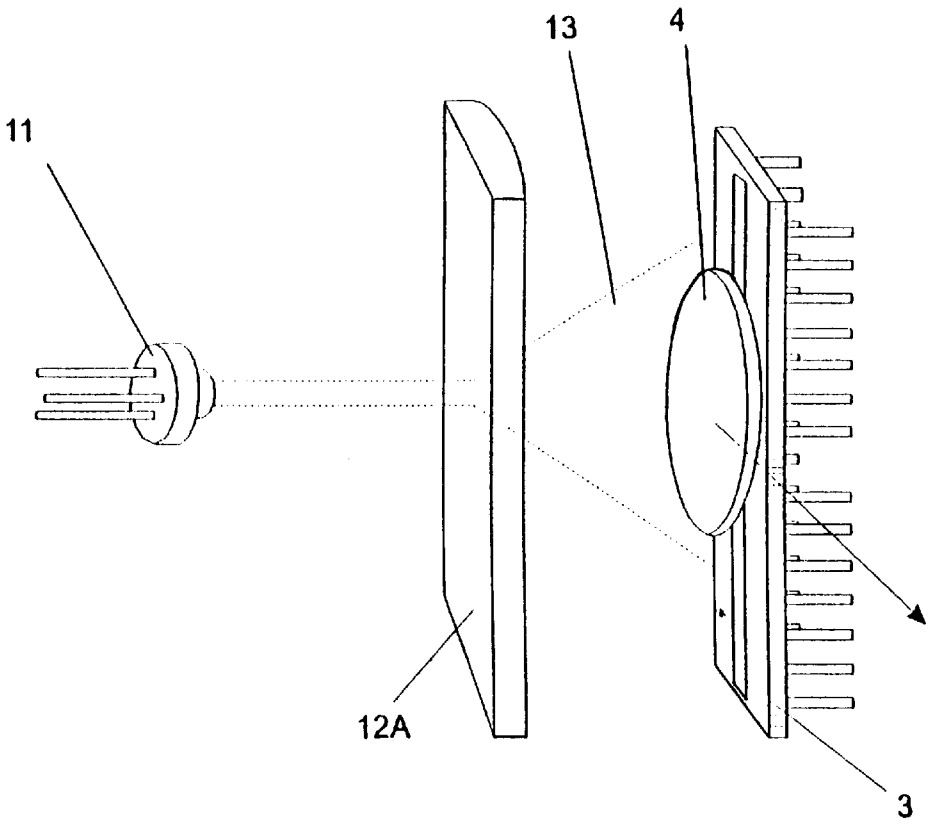
FIG. 4 is an illustration of a third embodiment in which the coin intercepts the laser beam as the coin is in free fall. An arrow is used to indicate the direction of the fall of the coin.

In contrast, in FIG. 4, if the laser beam intercepts the coin at an acute angle, the measurement taken at the linear sensor will be slightly larger than the actual size dimension of the coin. However, the coin testing apparatus would still work effectively, provided the data measurements of known coins are calculated taking this factor into account. Hence, it is preferable, but not essential to the invention in its broadest aspect, that the beam be absolutely perpendicular with the plane of the coin at the critical point of interception.

One advantage, however, of the perpendicularity of the coin and laser beam at the point of interception is that the use of a perpendicular beam makes it possible to take into account the deviations resulting from grooves in the edge of the coin. It can be appreciated that if the beam intercepts the edge of the coin at a substantially acute angle, the beam will be blind to the undulations of the grooves. The acute and angled beam will merely encounter a smooth circumference devoid of grooves or ridges.

In the second embodiment of FIG. 2, the first laser beam that is directed onto the face of the coin, as well as the second laser beam that is directed onto the edge of the coin, are both derived from the same beam which emanates from the single laser diode 11. The second laser beam is derived from the first laser beam by means of a prism which re-directs a portion of the first laser beam. However, in other embodiments of the invention, separate laser beams may be created by separate laser sources. Multiple laser diodes may be used.

Figure 2D:
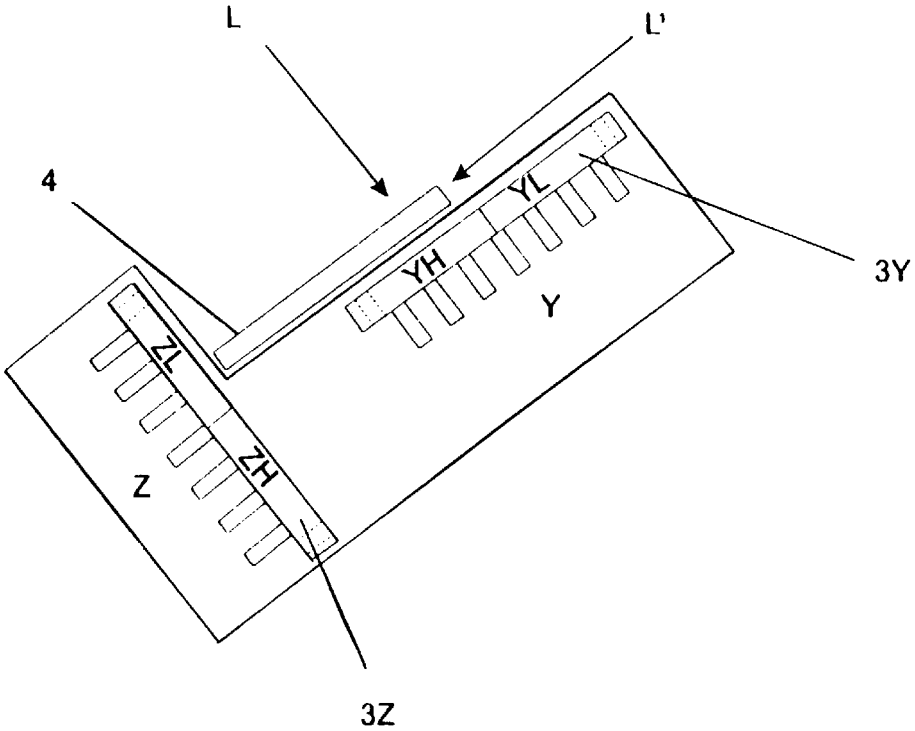
FIG. 2D illustrates the coin guide of FIG. 2A installed in a tilted orientation.

It is preferable that the coin guide of the apparatus be installed such that, in use, the coin guide is tilted. This tilted orientation of the coin guide is illustrated in FIG. 2D. The degree of tilt of the coin guide minimises the risk of wobbling of the coin as it moves along the coin guide. There would be the risk of wobbling when the coin is upright as it moves along the coin guide. The ability of the apparatus to distinguishing dimensions the order of several microns, means that any minor alignment of the coin in the coin guide will affect the accuracy of the apparatus. One approach to ensuring a degree of stability is to stop the coin before it passes the linear array, and then release the coin to allow it to proceed past the linear array.

Third Embodiment—Free Fall Embodiments

The invention may comprise embodiments where coins need not be continuously supported by a coin guide. For example, the coin guide may be in contact with the coin only until the point before the coin intercepts the laser beam. At the instant of intercepting the laser beam, the coin may actually be in free fall. Preferably, the coin traverses the laser beam before it begins to loose its original orientation in its fall through free space. Measurements may be taken during free fall at any part of the surface or edge of the coin. Compared to systems which do not use laser radiation, coin measurements using lasers may be made sufficiently quickly, such that it would be possible to make measurements of a coin while the coin is in free fall.

FIG. 4 is an illustration of a third embodiment in which the coin intercepts the laser beam as the coin is in free fall. In this embodiment, a long linear sensor 3 is used. The use of a long sensor array allows the entire area and diameter to be measured as the coin falls past the sensor array 3. The lens in this third embodiment is selected to provide a wide fan shaped scope. The wide angle of the laser beam, and the long linear sensor, together combine to enable measurements to be taken of the coin over a longer distance of the coin's travel. This is especially useful since the free-falling coin would travel more rapidly than coin rolling over a coin guide. The laser beam 13 strikes the upper edge of the coin at an acute angle. Measurement is made in relation to the front face of the coin. As mentioned above, the acuteness of the angle means that the measurement has to take into account the spreading of the beam.

Alternative Embodiments

The invention is not limited to the having the laser source and laser detector perpendicular to the main plane of the coin.

Figure 5:
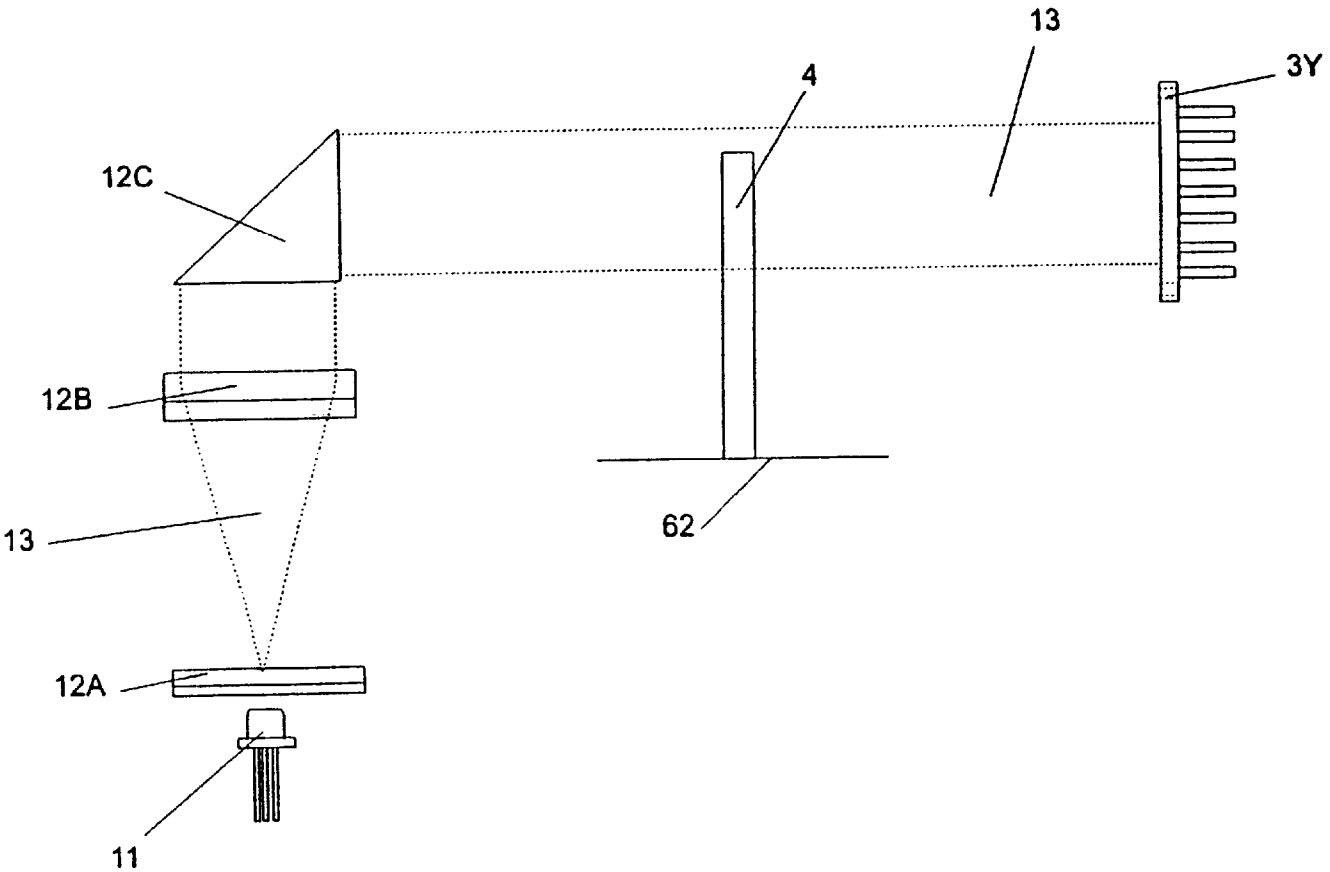
FIGS. 5 and 6 are schematic diagrams of alternative embodiments which serve to illustrate that the invention may also be able to incorporate laser sources and laser detectors that are not positioned perpendicularly to the main plane of the coin.
Figure 6:
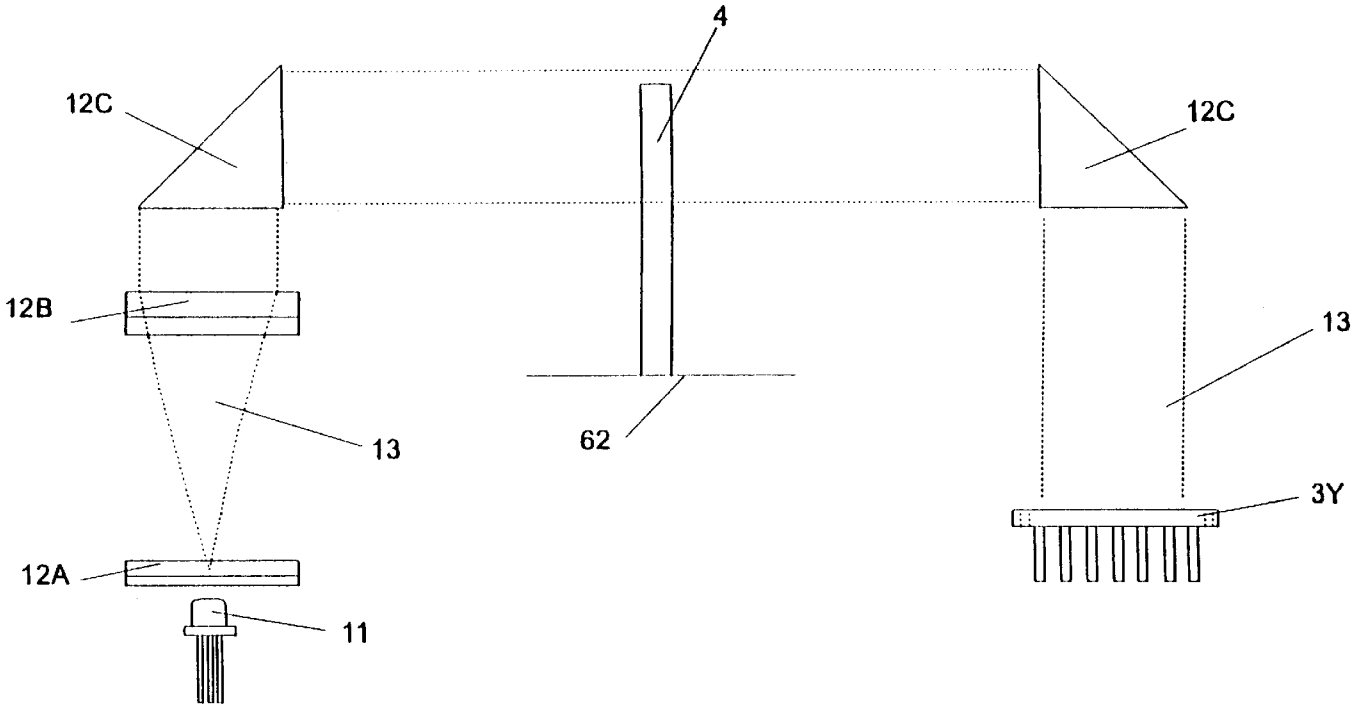

In the alternative embodiments shown in FIGS. 5 and 6, mirrors and/or prisms 12*c* are used to re-direct the laser beam 13. In these alternate arrangements, the laser beam 13 is still able to traverse the plane of the coin in a perpendicular manner.

In certain embodiments, optical fibres may be used to transmit the laser radiation towards the laser radiation detector. Optical fibres may be used to direct the laser radiation along paths which may require complex arrangements of lens and/or prisms. The optional use of mirrors, prisms, and/or optical fibres to re-direct the laser beam may result in compact designs of the coin testing apparatus.

Lasers

A laser radiation source, such as a laser diode, is particularly suited to such a coin testing apparatus because a laser is a coherent and highly directional radiation source. Any other non-laser radiation and light are incoherent. The unique characteristics of laser radiation arise from a process known as stimulated radiation emission, whereas ordinary light arises from spontaneous emission. Laser radiation arises from stimulated emission of a confined beam of photons and atoms in a single quantum state.

A laser is also particularly suitable because of the long working life of such sources. (Current typical values of laser sources are 10,000 to 80,000 hours, 1 to 9 years. Other estimates for the lifetime of laser diodes suggest a lifetime of 500,000 hours).

Apparatus of embodiments of the invention may use a range of laser diode systems designed for original equipment manufacturer (OEM) use, having their output powers set in accordance with BS(EN)60825. When incorporated in the above mentioned apparatus, it may be necessary for additional safety features to be added so as to ensure that the equipment complies fully with the standard. However, the invention in its broadest aspect is not strictly limited to including such safety features.

The area of the laser beam output by the laser diode 11, in a practical embodiment of the invention, is (height×width) 2.5 mm×1 mm, the expanded area on reaching the linear array 3 being 30.0 mm×1.2 mm.

The laser unit operates from a positive voltage and runs from an unregulated supply in the range of 5 to 6V. However, it is preferred that a lower voltage be used, since the generation of a lower amount of heat tends to prolong the expected lifetime of the equipment. In such circumstances a 4.5V supply, illustrated in FIG. 11, regulated to within ±5%, is used to power the laser unit. The casing of the laser module is preferably isolated from the supply voltage.

A practical embodiment of the invention uses a laser diode 11 that produces laser radiation having a wavelength in the range from 635 nm to 840 nm, depending upon the normalised response of the sensor unit 3. The wavelength of the laser radiation is chosen to maximise the response of the sensor unit 3, so as to increase the performance of the apparatus. However, the invention is not limited to the use of a particular wavelength of laser radiation, and a range of laser sources may be used, for example, from 330 nm to 1500 nm which covers the near UV to near-infrared spectral region.

A TTL disable function is available on laser modules which operate from a negative supply voltage. An input of between +4 and +7V applied to the TTL disable input will turn the laser off and an input of 0V will turn it on. If it is not in use, this input may be left floating. The laser may be pulsed on and off, using this input, at a frequency of 10 Hz or more. However, continuous energization of the laser diode is preferred in the above-mentioned practical embodiment, since this tends to give a longer working life for the diode.

When the laser in the above-mentioned practical embodiment is operating at a voltage above the minimum supply voltage, and/or at a temperature of more than 50° C. degrees above ambient, an additional heat sink should be used. If the temperature of the laser diode casing were to exceed its maximum specification, premature or even catastrophic failure could occur. To help dissipate heat from the laser module, the laser unit 1 preferably has a cylindrical casing holding the laser diode and the lenses for focusing the beam (FIG. 1). The casing is made of PMMA (poly-methylmethacrylate), but may be made of other materials such as Aluminium.

Linear Sensor Array

Figure 8:
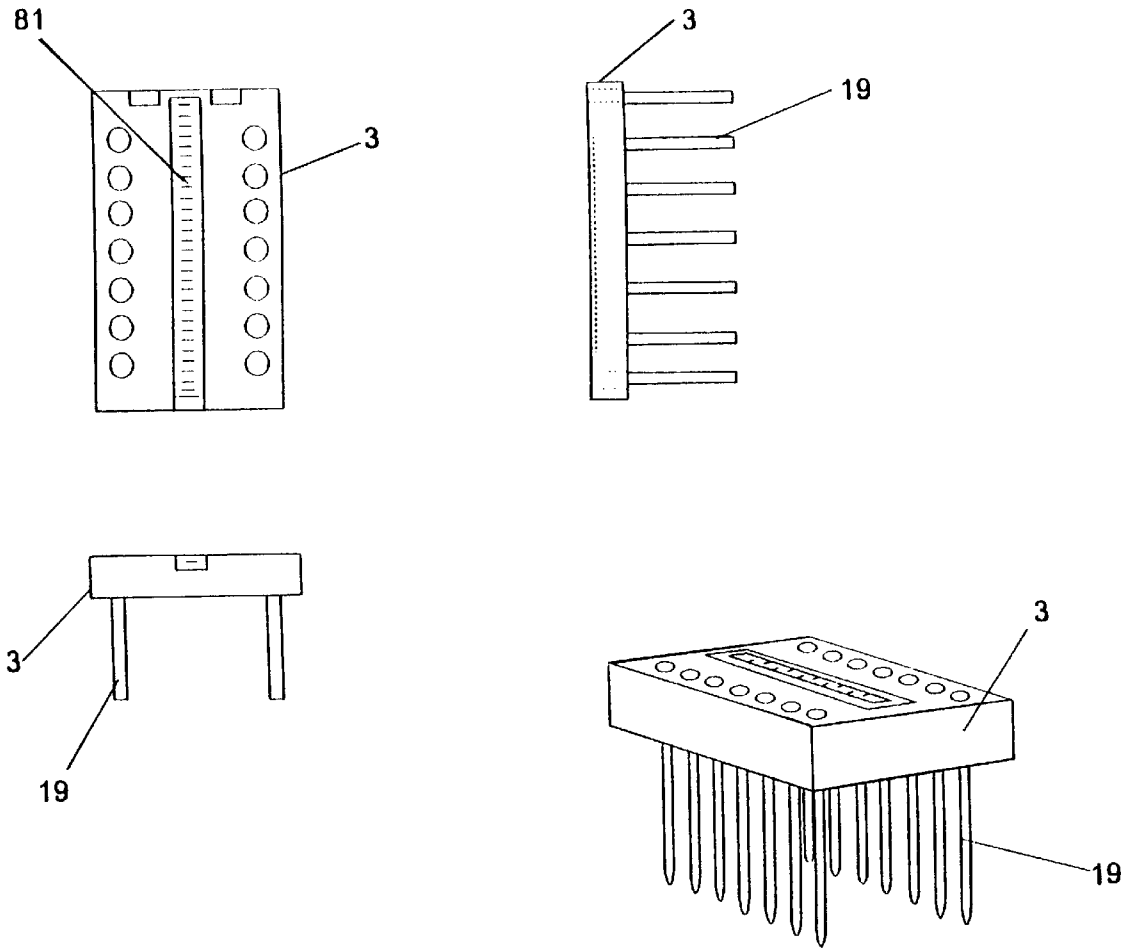
FIG. 8 shows several views of a sensor unit used in the embodiments of FIGS. 1 and 2.

The laser detectors used in the exemplary embodiments are in the form of linear sensor array units 3. In FIG. 8, the sensor array unit 3 is provided by a product integrated sensor CMOS process linear sensor array with hold as shown in FIGS. 8, 9. Such a sensor comprises a linear array 81 having 256×1 pixel array sensors (each 63.5 $\mu$m by 55 $\mu$m at 8.5 $\mu$m spacing between pixels), each of which produces a signal dependent on the amount of laser radiation received by the pixel concerned. However, other embodiments of the invention may advantageously incorporate linear arrays having a much larger number of pixel sensors. For example, a larger number of pixel sensors would enable a greater amount of information to be derived during the process of measurement of the coin. Consequently, the increase in the amount of information would enhance the accuracy of measurements, particularly in those embodiment which require integration or summing of measurements, as will be described later.

It will be appreciated that the smaller and more densely packed are the pixels, the greater will be the accuracy of the coin recognition results.

The array is formed from two parallel-connected arrays of 128 pixels, such as shown in FIG. 9. Each of the 128 pixels is controlled by a 128 bit shift register comprising a switch-control logic, charge accumulators, and an output amplifier which regulates the train of data from the pixels.

The outputs from the individual pixels, for each sampling period determined by a pulse input S1 as described below, are transmitted from pins 4 and 8 (AO1 and AO2) of the sensor unit 3, in the form of a train of digital pulses. As can be seen from FIG. 9, the sensor array unit 3 has a clock input CLK, an external triggering pulse input S11 and S12, and outputs AO1 (pixels 1–128) and AO2 (pixels 129–256). The array connection may alternatively be serial.

In FIG. 8, the array 81 of two hundred and fifty-six sensor elements provides two hundred and fifty-six discrete pixels. Laser radiation energy striking a pixel generates electron-hole pairs in the region under the pixel. The filed generated by the bias on the pixel causes the electrons to collect in the element while the holes are swept into the substrate. The amount of charge accumulated in each element is directly proportional to the amount of incident laser radiation and the sampling period.

The use of laser radiation is an important feature of the invention. Earlier apparatus that do not utilise laser radiation will not achieve the full advantages of the present invention. The pixels measure 63.5 $\mu$m by 55 $\mu$m with 63.5 $\mu$m center-to-center spacing. Each pixel is separated by a distance of 8.5 $\mu$m. Due to the use of laser radiation, the system is capable of detecting changes in dimensions of the coin in steps of around ± one pixel, i.e. around 63.5 $\mu$m. This is because laser radiation is of a single wavelength, and there is minimal scattering of the laser beam, as compared to the light scattering which would be associated with optical light. This characteristic of laser beams enable extremely small differences in the dimensions of the coins to be identified. The wavelength of the laser radiation source used in the present embodiment has a wavelength with $\lambda$=670 nm, although it is appreciated that the invention is not limited to a particular wavelength of laser radiation. As a result, differences between coins as minute as one pixel, i.e. 63.5 $\mu$m or 0.0635 mm, may be identified using the apparatus of the present embodiment.

Fortunately, in cases where the diameter of several currency coins differ by only one pixel, these coins also differ substantially in the measurements of their thickness. For example, the United States and Canadian one cent coins each have substantially the same diameter, but each also differ in their thickness by around 160 $\mu$m or 0.16 mm. Hence, even though the diameters of the Canadian and United States one cent coins differ by a matter of a pixel, these coins may be identified by differences in their thickness. Therefore, in addition to taking measurements from the face of the coin, it is preferable to also take measurements of the thickness of the coins. However, testing of coins may rely on the measurement of one dimension when a limited number of coins are to be accepted, and wherein such a number of coins the differences between coins are significant.

Figure 9A:
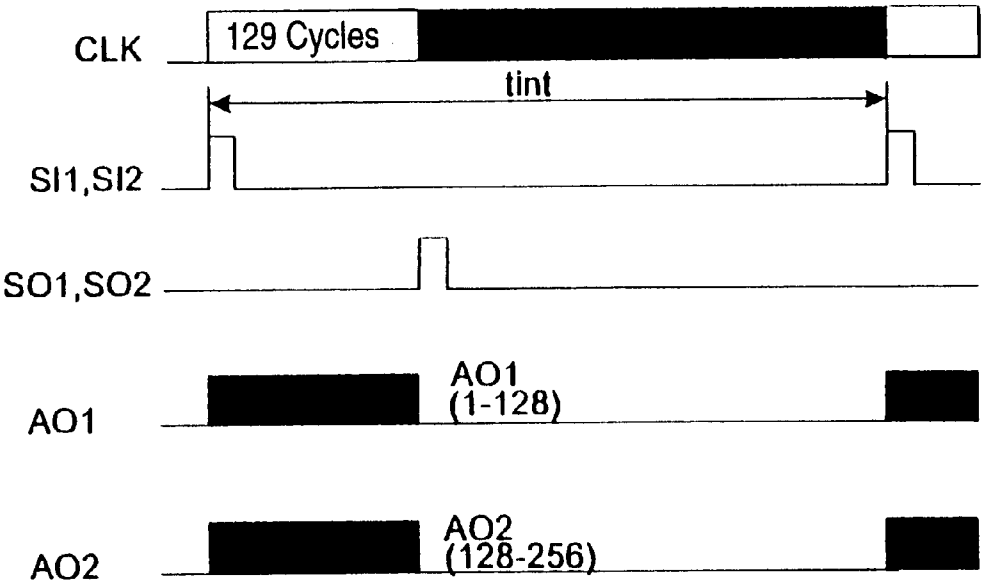
FIG. 9A is a timing diagram of a linear array, in parallel connection, showing pulses relating to the sensor unit of FIGS. 8 and 9.

As illustrated in FIG. 9A, operation of the 256×1 array sensor is characterised by two time periods: an integration period $t_{int}$ (the aforementioned sampling period) during which charge is generated in the pixels by the bias, and an output period $t_{out}$ during which a train of digital output signals for one sampling period is transmitted from the common outputs AO1 and AO2. The integration period is defined by the interval $t_{int}$ between successive control pulse S1 which are applied to pin 2 (S11) and pin 10 (S12) of the unit 3. The required length of the integration period depends upon the amount of incident laser radiation and the desired output signal level.

In the embodiment, the sensor consists of 256 pixels arranged to form a linear array. As laser radiation energy impinges on each pixel, a photo current is generated. This current is then integrated by an active integration circuitry associated with that pixel.

During the integration period, a sampling capacitor connects to the output of the integrator through an analogue switch. The amount of charge accumulated at each pixel is directly proportional to the laser energy on that pixel and the integration time.

Figure 11:
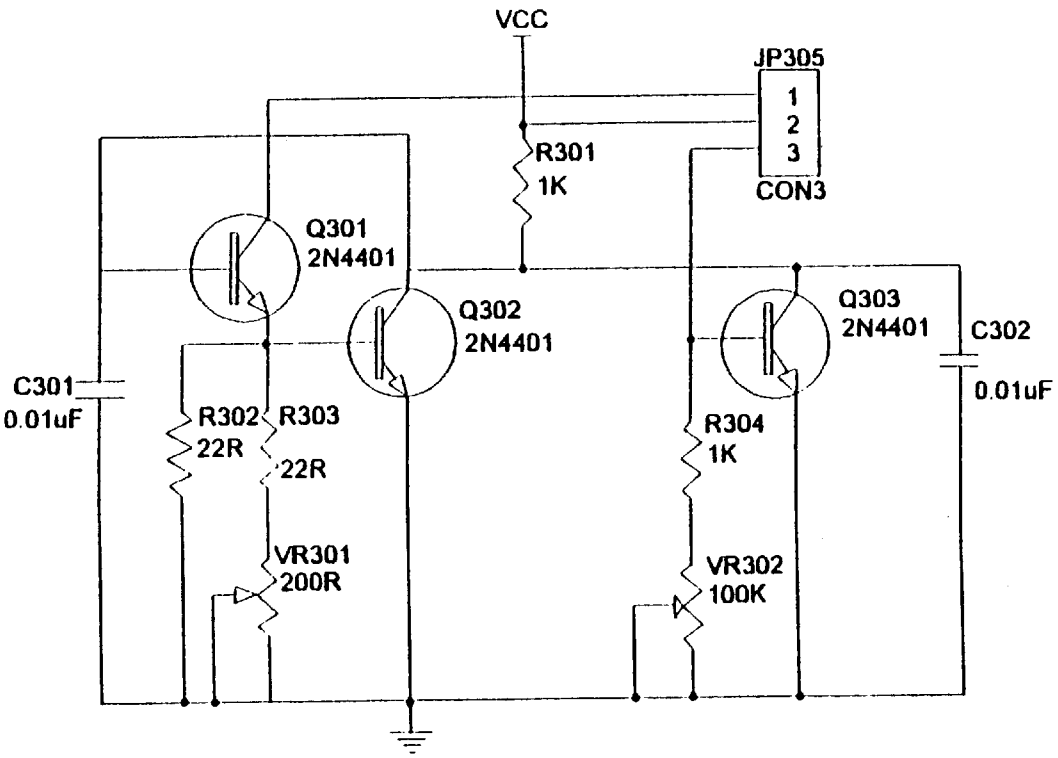
FIG. 11 is a circuit diagram of the laser power supply.
Figure 11A:
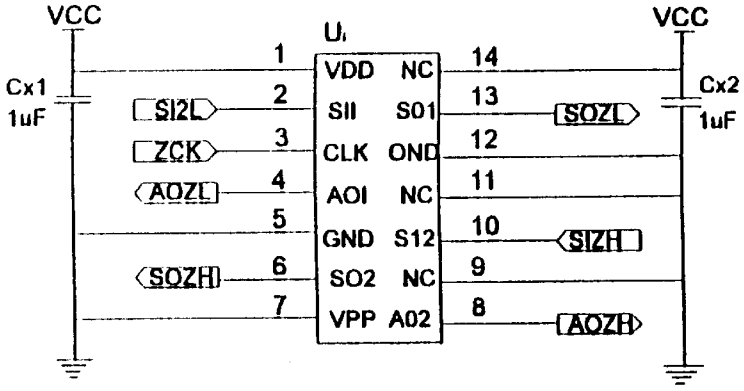
FIG. 11A show Y-Z Sensor Array pin-out used in the apparatus of FIGS. 1 and 2.
Figure 11A:
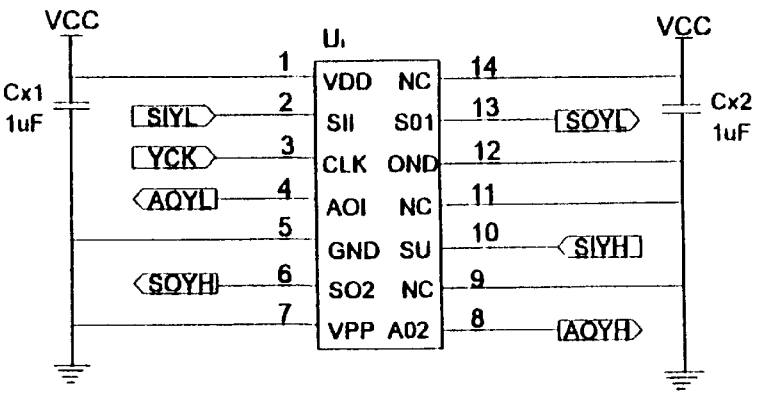

In FIG. 11A, the output and reset of the integrators is controlled by a 256-bit shift register and reset logic. An output cycle is initiated by clocking in a logic 1 on S11 (pin 2) and in S12 (pin 10). Another signal, called Hold, is generated from the rising edge of S11 and S12 and simultaneously transmitted to sections 1 and 2. This causes all 256 sampling capacitors to be disconnected from their respective integrator and starts an integrator reset period. As the S1 pulse is clocked through the shift register, the charge stored on the sampling capacitors is sequentially connected to a charge-coupled output amplifier that generates a voltage on analogue output AO. The integrator reset period ends 18 clock cycles after the S1 pulse is clocked in. Then the next integration period begins. On the 128th clock rising edge, the S11 pulse is clocked out on the SO1 pin 13 (section 1). The rising edge of the 129th clock cycle terminates the SO1 pulse, and returns the analogue output AO1 of section 1 to high-impedance state. Similarly, SO2 is clocked out on the 256th clock pulse. A 257th clock pulse is needed to terminate the SO2 pulse and return AO2 to the high-impedance state.

AO is driven by a source follower that requires an external pulldown resistor. When the output is not in the output phase, it is in a high impedance state. The output is normally 0V for no power input and 2V for a nominal full-scale output.

In further embodiments, the laser detector may comprise a number of linear sensor array units arranged in a matrix orientation. The benefit of using such a matrix sensor is that the laser detector is provided with a larger surface area.

First Generation Electronics

Figure 10:
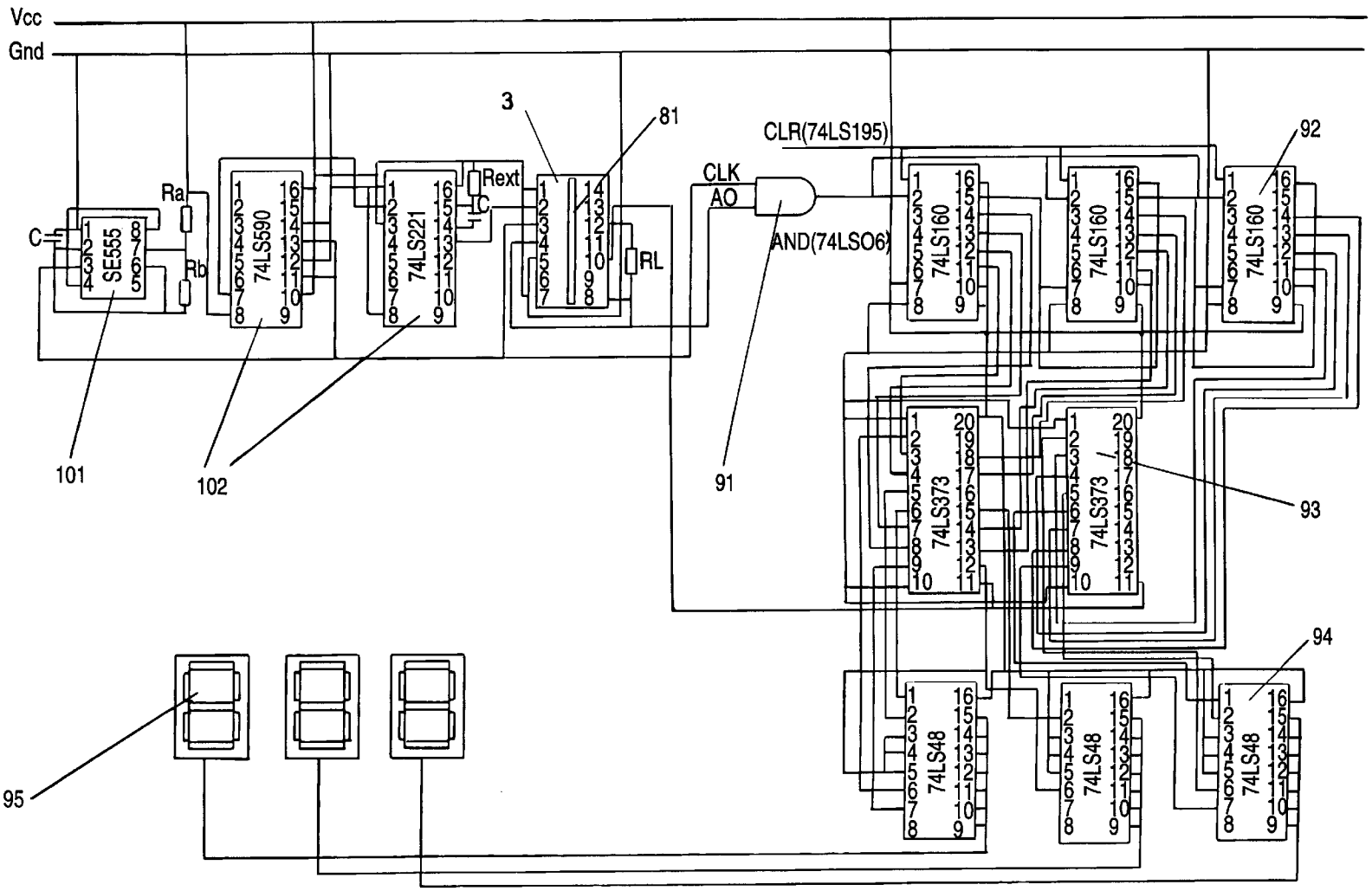
FIG. 10 is a circuit diagram used in the first generation electronics used in the embodiment of FIG. 1.

The clock signal CLK and the control signal S1 can be produced by any suitable timing circuit, for example, that shown in FIG. 10, in which a 555 timer circuit 101 produces the clock signal CLK, whilst an 8-bit counter 74LS590 and a Schmitt-trigger 74LS221, references as circuits 102, produce the control signal.

The sensor array unit 3 transmits the output digital pulse train to, for example, a counter circuit shown in FIG. 10 which includes a series of three 4-bit counters 74LS160 linked together to form a single 12-bit counter 92. This counter 92 receives a signal from an AND gate 91, which gate combines a clock signal CLK and the digital serial output signal of the sensor unit 3. As each charge accumulator signal, which may have the value "1" or "0", is produced by the pixels in the linear array unit 3, it is clocked into the counter input by the clock signal CLK. A charge accumulator signal equal to "1" causes the counter to be incremented.

When all 256 bits relating to the 256 sensing pixels in the senor array unit 3 have been transmitted by the sensor unit 3, a signal SO2 from the sensor array unit 3 triggers a set of latches 93, 74LD373 so that the result of the count of the 256 pixels is latched onto the outputs thereof. These outputs are then decoded by 7-segment display drivers 74LS48, shown as numeral 94 in the drawing, to produce a three digit number on 7-segment LED displays 95. This number corresponds to the specific examined area of the coin concerned.

The outputs from the sensor array unit 3 are also applied as inputs to a main control comparison circuit (FIG. 14) which compare the outputs with predetermined reference values stored in a data library 16 and corresponding to the number of coins that the apparatus is intended to identify. The data library is in the form of flash RAM. The comparison circuit 15, in the form of an EEPROM, is illustrated in FIG. 14. The comparison circuit provides an output signal SC identifying the coin tested.

2nd Generation Electronics

The following is a description of the second generation of electronics used in embodiments of the invention, which have been derived through further research and development.

Y-Sensor Array

Referring to FIG. 2D, this sensor indirectly measures the Area, radius and diameter of the coin 4. It may detect and count the present of grooves and ridges at the edge of the coin.

Figure 11B:
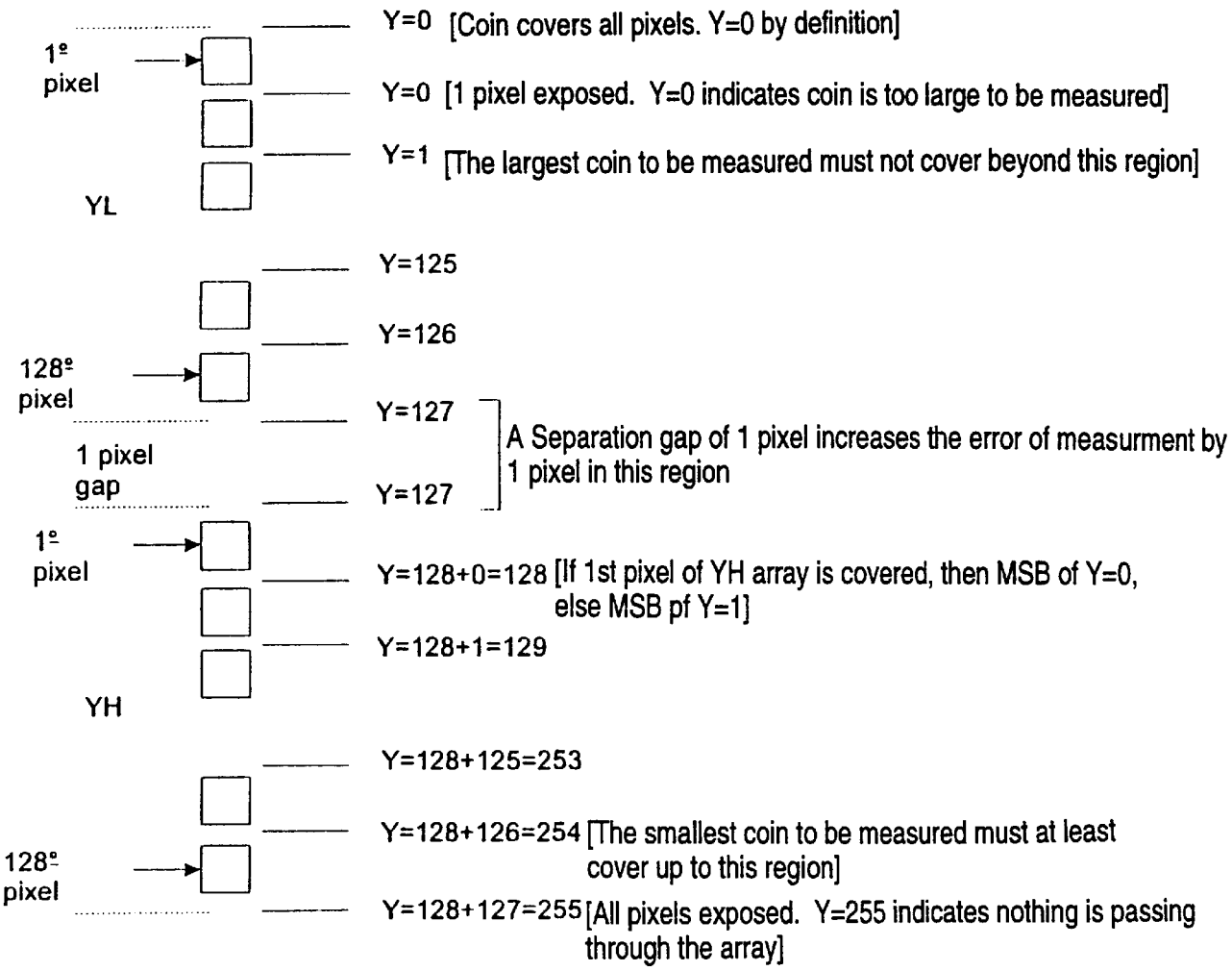
FIG. 11B is a diagram which explains the pixel layout.

The sensor array consists of two smaller arrays YH and YL. Each consists of 128 pixels. The layout of these pixels is explained in diagrammatical form in FIG. 11B. During each scan, the electronics will generate a number Y which is defined as follows: If (number of pixels exposed)=0, let Y=0, else Y=(number of pixels esposed)−1.

Operating at a clock frequency of 2 MHz, the sensor can output all 128 pixels of each array in 64.5 ns. The maximum possible scanning rate is therefore 15,503 scans per second, or 4 million digits '0' or '1' per second. If a coin passes through the array at 1 m/sec, then every 1 mm of the coin is scanned about 16 times. This is sufficient to determine the minimum value of Y as the coin passes through the array. The minimum value of Y corresponds to the diameter of the coin. During each scan, the S1 pulse generated by U204 will initiate the shift-out cycle at each pixel in YL and YH. U301 will start to count the number of 'high' pixels in either YL or YH. Pixels exposed to the laser L, will give 'high' outputs while pixels covered by a coin or not exposed to the laser will give 'low' outputs. As soon as the first 'low' pixel is encountered, U301 stops counting.

If the coin covers beyond the YH array, then the first pixel of YH is 'low'. The value of Y will be less than 128, i.e. Y7=0. U301 will count the 'high' pixels in the YL array only.

If the coin does not cover beyond the YH array, then the first pixel of YH is 'high'. All pixels of YL will be exposed and therefore, Y will be greater than 127, i.e. Y7=1.

U301 will count the 'high' pixels in the YH array only. At the end of the shift-out cycle, count value of U301 and Y7 will be latched to U205 as the Y value and subsequently read by the PC/or Microcontroller.

The first S1 pulse to the Y-sensor array is generated by the 2 power-up reset pulses PUR1 and PUR2, to initiate the first shift-out cycle. At the end of the shift-out cycle, the sensor array generates an SO pulse which is used to regenerate th S1 pulse. In this way the sensor scans and shifts out data indefinitely at its maximum rate.

Z-sensor array

This sensor array directly measures the thickness of the coin. Only the first half (ZL) of the array is used.

Figure 2E:
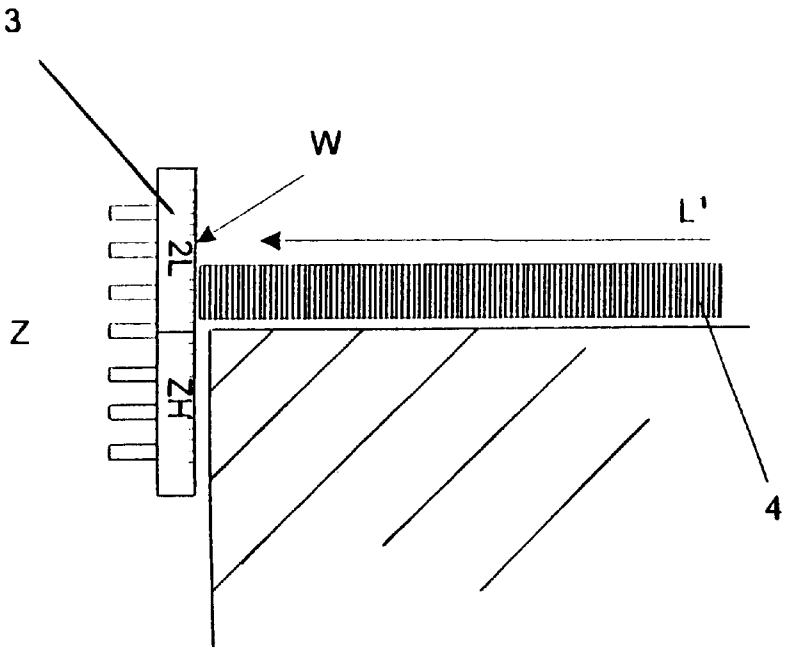
FIG. 2E shows an arrangement for measuring coin thickness.
Figure 3:
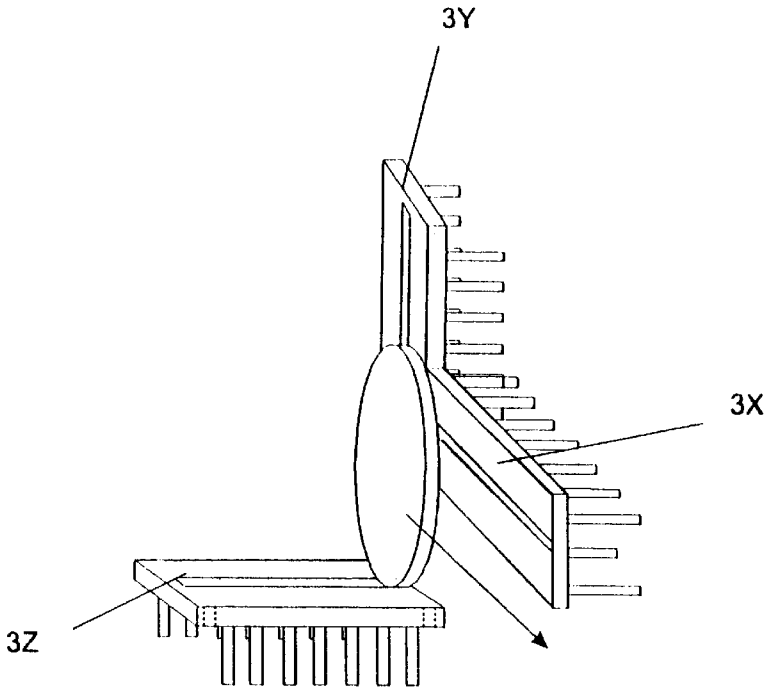
FIG. 3 is an illustration which uses the letters X, Y and Z to indicate the spatial arrangements of three linear arrays used in a further embodiment.

Referring to FIG. 2E, a window W, opening allows a certain number of pixels of the ZL array to be exposed to the laser L'. When a coin passes through the window, the number of pixels blocked by the coin is directly proportional to the thickness of the coin. Knowing the centre-to-centre spacing between pixels, the actual thickness at the coin can be calculated.

The Z-sensor array works in parallel with the Y-sensor array, sharing the same 2 MHz clock and S1 pulse.

Unlike U301, U302 simply counts the number of 'high' pixels in the ZL array. At the end of the shift-out cycle, the count value of U302 is latched to U206 as the Z value and subsequently read by the Microcontroller, U101.

Figure 10A:
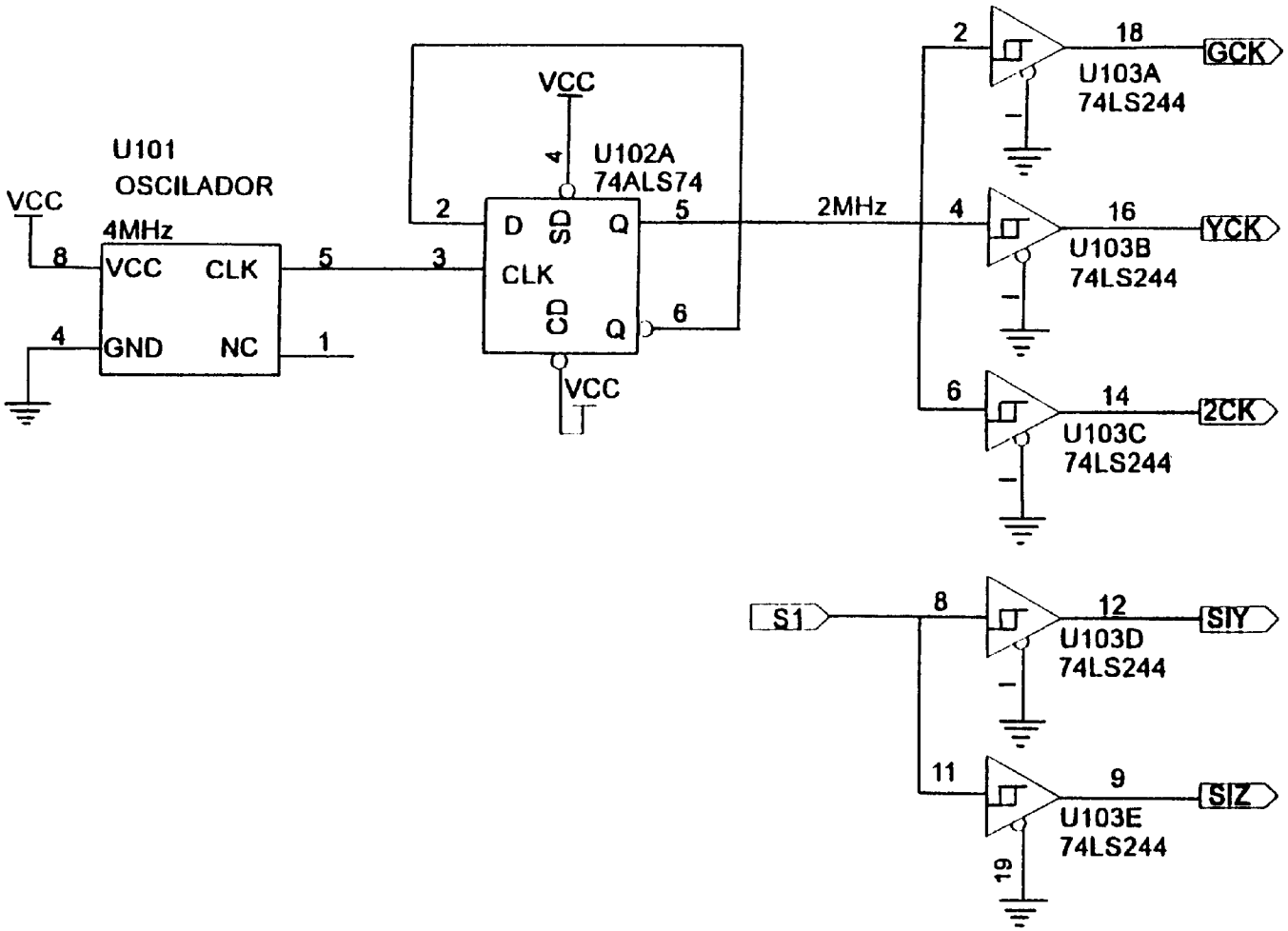
FIG. 10A shows a block circuit diagram of a clock signal generating circuit used in the embodiments of FIGS. 1 and 2.

In FIG. 10A, a clock distributor U101 generates a frequency of 4 MHz. From the clock distributor, an 74LS74 D-type flip flop, U102A, is used to divide the frequency in half to 2 MHz. The flip flop is used in conjunction with Schmitt triggers to provide timing for the microelectronics of the circuitry used in the apparatus.

Figure 10B:
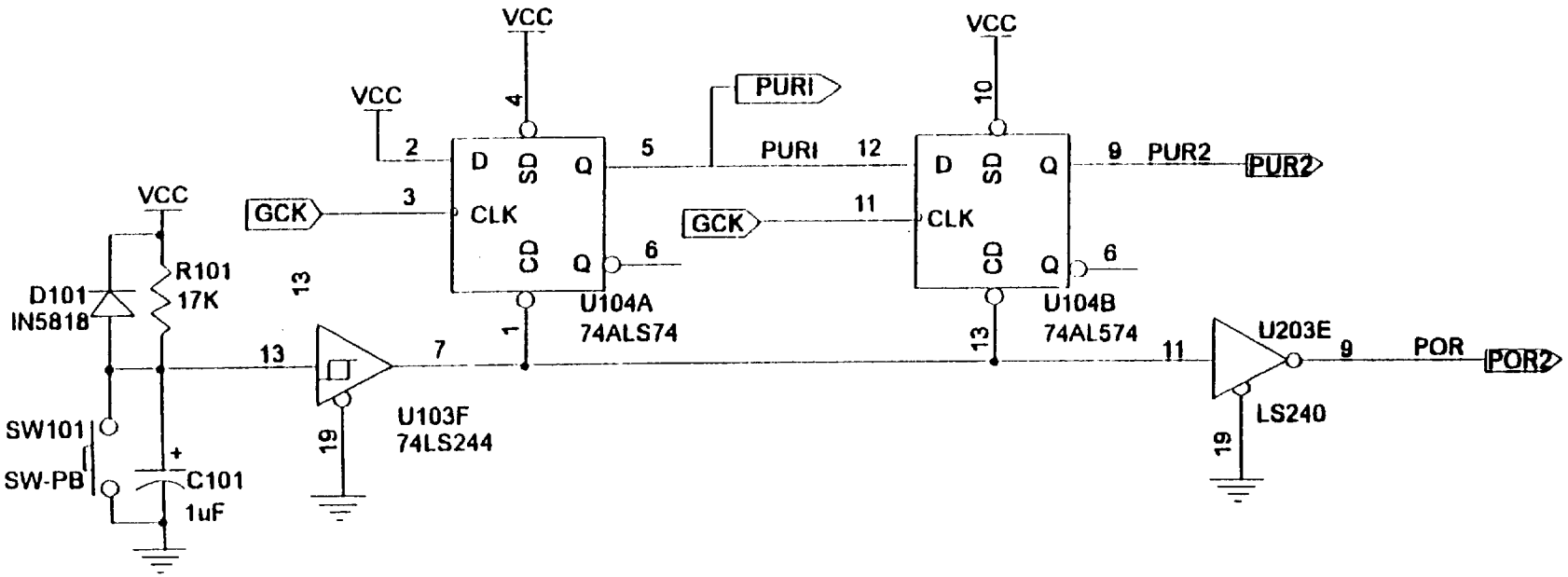
FIG. 10B shows a "power-on" circuit.

In FIG. 10B, a circuit is illustrated which resets the logic from a "power-off" state to a "power-on" state. The reset logic circuit includes two 74ALS74, a switch and a number of Schmitt triggers.

In FIG. 11, a laser power supply is illustrated which is provided with a current driver. The current driver is used to protect against variations in the driving current, which would lead to consequential failure of the diode.

Figure 11C:
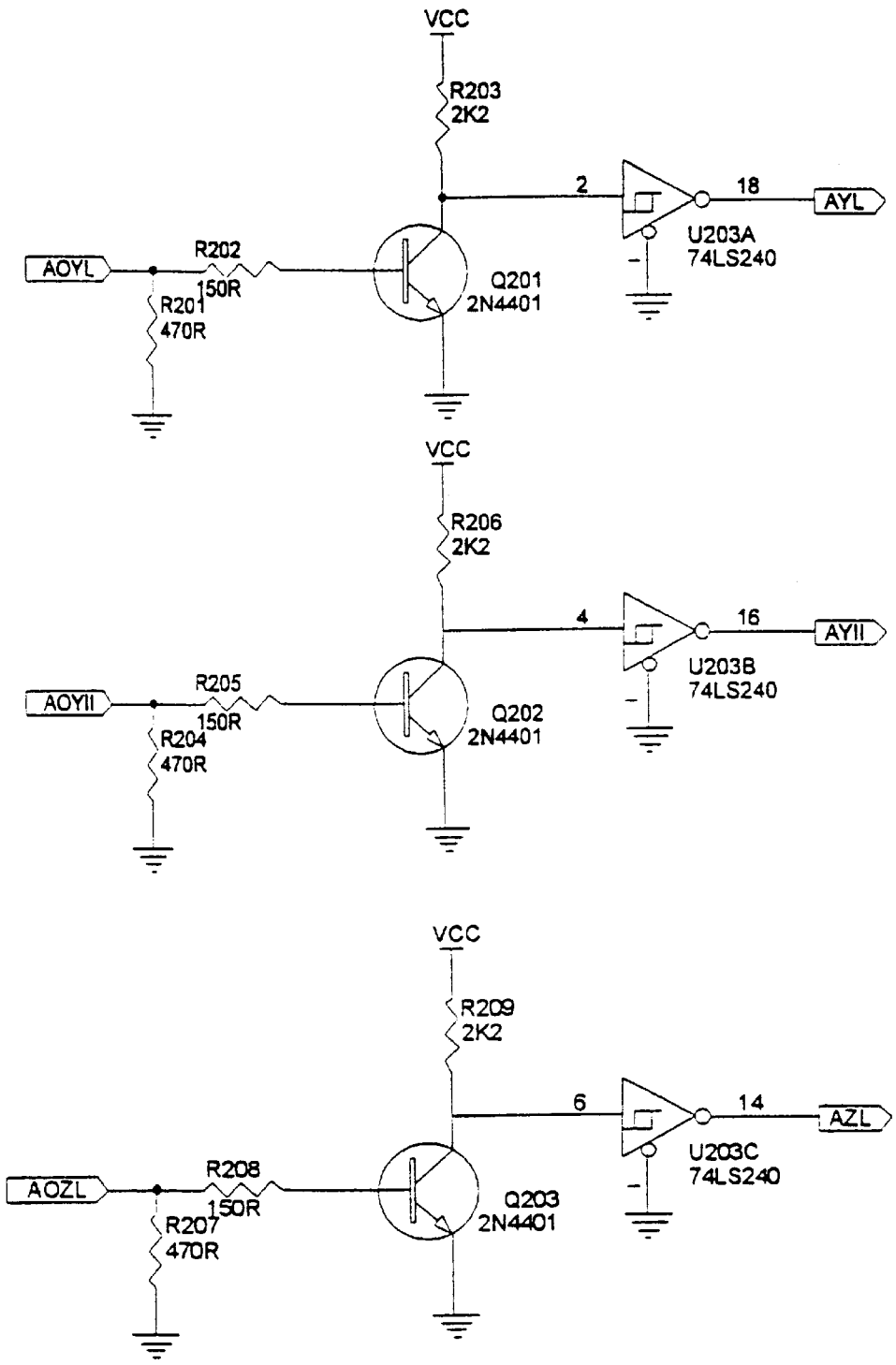
FIG. 11C shows three level converters for analogue to digital conversion.

Referring to FIGS. 11A, analogue signals are transmitted from the linear array pin-out to the level converter 17, as shown in FIG. 11C.

In FIG. 11C and FIG. 14, the level converter 17 converts the analogue signals to digital form. The digital signals are sent to the counter in FIG. 12, U204.(PAL 22V10). The counter counts the pixels which are in the excited state and those which are not in the excite state. The digital count of the pixels is then processed by the two latches U205, U206 (74ALS374) shown in FIG. 12A. The digital count is sent individually to two separate buffers which work in conjunction with each other, as shown in FIG. 12B. The buffers (U301, U302) form an interface between the controller and the linear arrays YZ.

In FIG. 12C, an Intel™ 196NU controller is used to read the data received from the buffer. The controller controls the algorithm and the instructions stored in the static RAM and the EEPROM during the process where the coin passes the linear array. During this process, the data obtained from the linear arrays is compared with the data information stored in the flash memory.

Figure 12D:
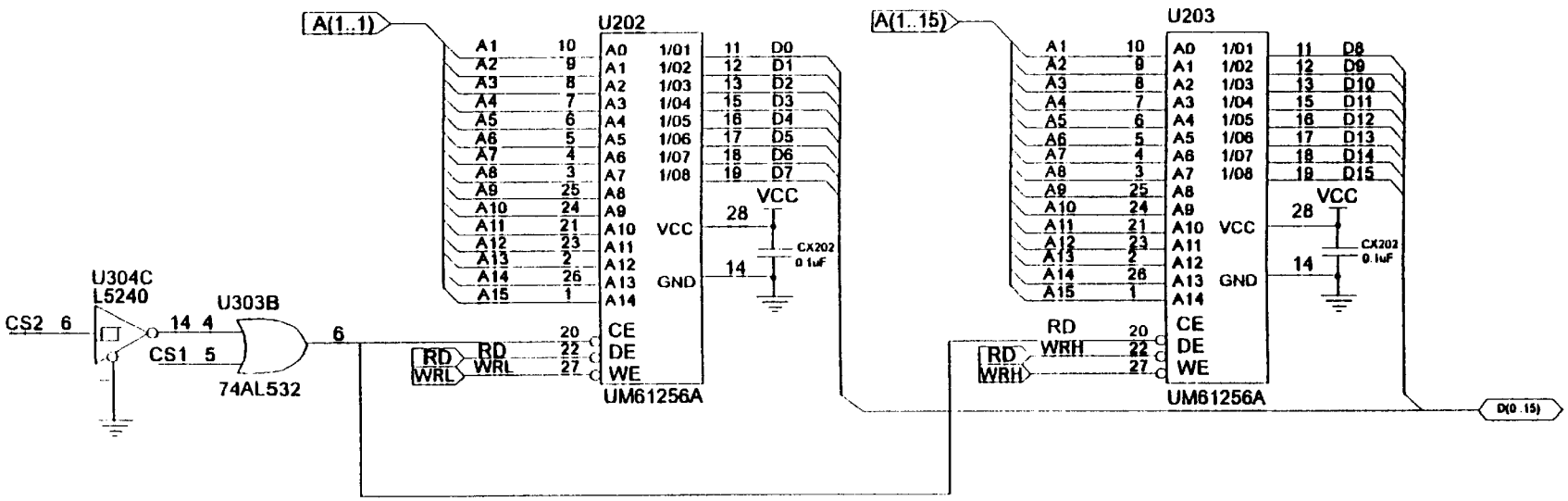
FIG. 12D shows two static memory RAM circuits.

Following the digitalisation of the flow data information received from the linear array, the digitalised information is stored in two static memory RAM, shown in FIG. 12D, until the microcontroller is able to take the data for analysis.

Figure 12E:
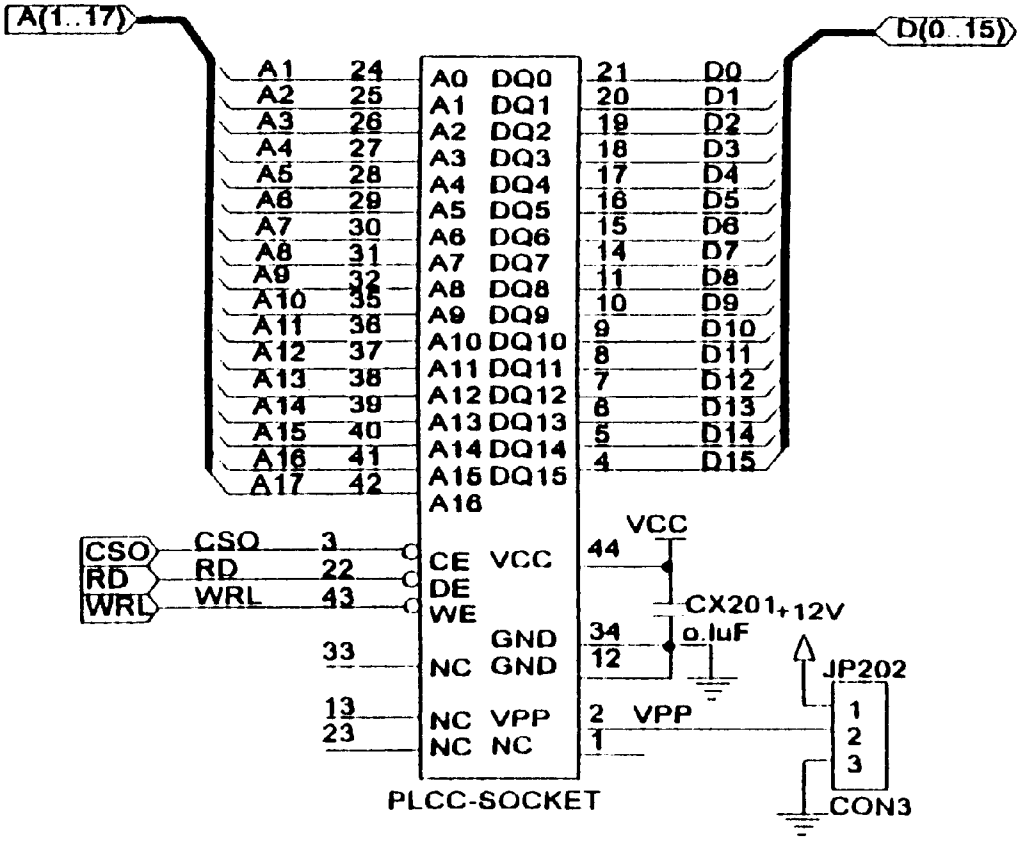
FIG. 12E shows a flash memory EEPROM circuit.

In FIG. 12E, an EEPROM flash memory is used to store instructions for the controller. These instructions include calibration data which relate to the calibration of the apparatus, data of know coins, and also includes values of constants used in the mathematical algorithm.

Figure 12F:
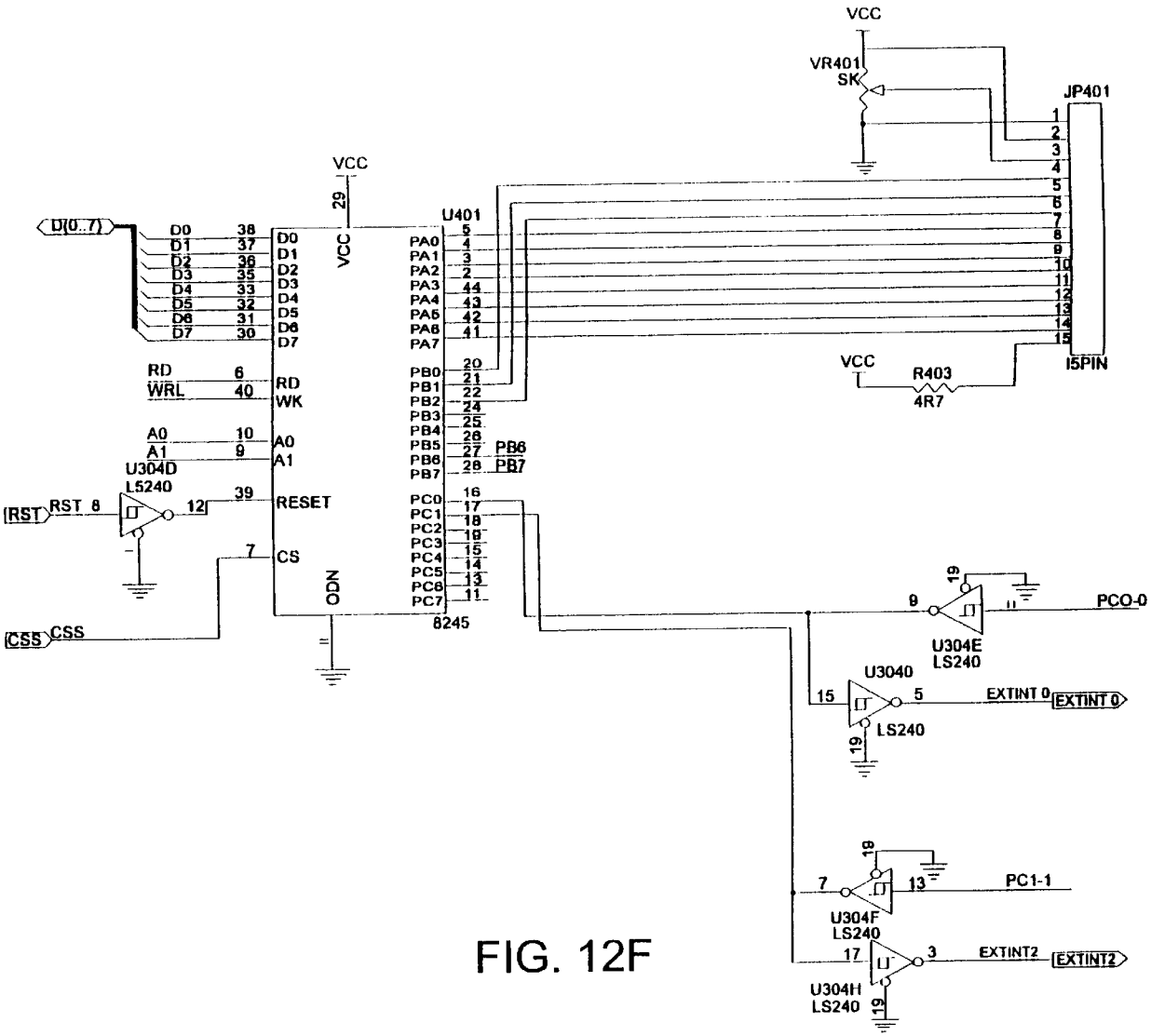
FIG. 12F shows a LCD driver, relays and photo-transistor driver.
Figure 12G:
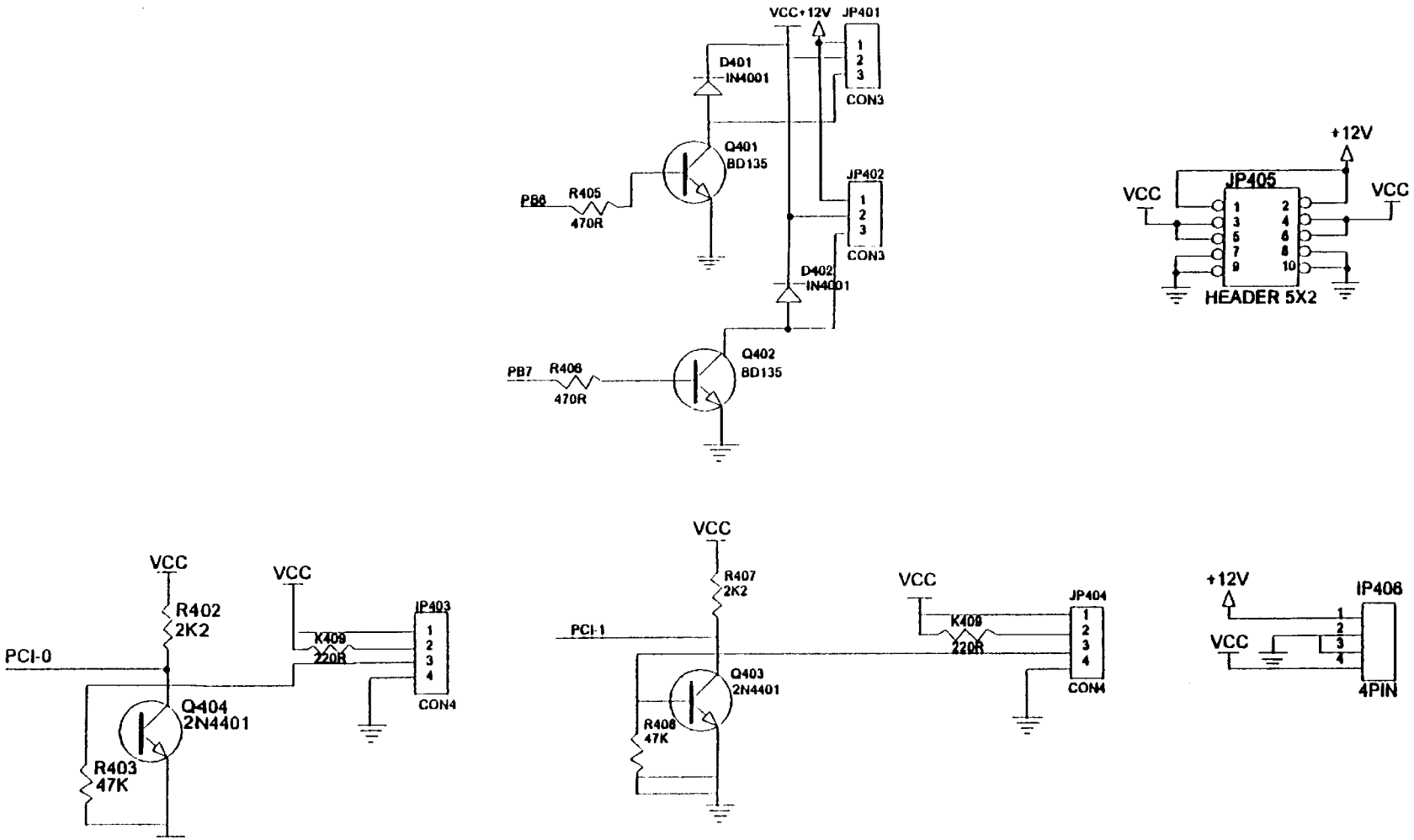
FIG. 12G shows a relay PIN driver and PIN photosensors.

A circuit for an LCD intelligent display driver U401, illustrated in FIG. 12F and FIG. 14 (as numeral 18). The display driver is an A25510. In FIG. 12F, the driver also drives relays which are used to open and close two valves (shown in FIG. 12G). Two photosensors, which are also controlled by the driver, are used to detect the entry and exit of the coin from the passageway 52.

Figure 12H:
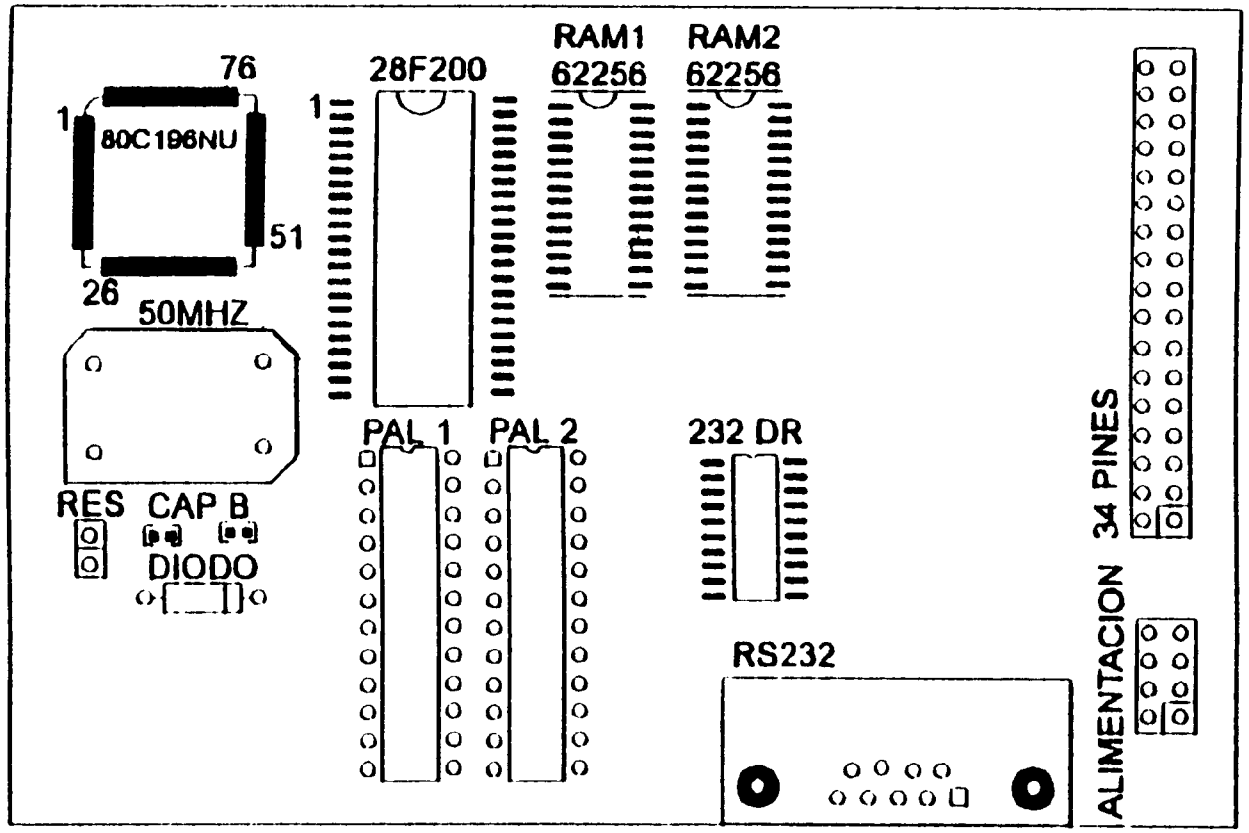
FIGS. 12H and 12I show printed circuit boards useable in the circuitry of the embodiments.
Figure 12I:
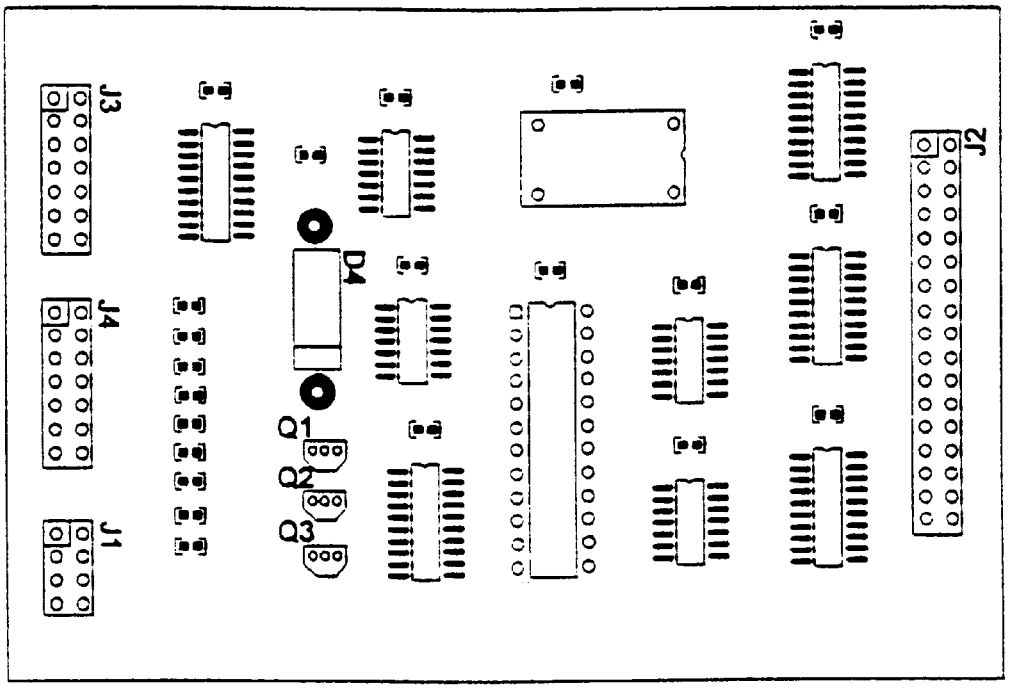

FIGS. 12H and 12I show examples of printed circuit boards useable in the circuitry of the embodiments.

Coin Identification

When the coin 4 prevents a portion of the laser beam 13 from shining onto the linear sensor array 3, the linear array 3 detects where the laser is intercepted by the coin and where the laser is not intercepted by the coin. This information is used to obtain an indication of a characteristic of the face of the coin.

In basic embodiments of the invention, the length of at lest part of at least one elongate strip of the face of the coin is determined or detected. For example, this elongate strip may be the diameter of a circular coin, or the maximum cross section of the non-circular coin, or it may be a portion of these measurements. Obtaining this information enables the coin to be identified, by matching this information with corresponding data of know coins. The present invention uses lasers to obtain this information, and is therefore faster and is able to distinguish a larger number of coins compared to earlier apparatus and methods.

In further embodiments of the invention, the lengths are determined or detected of at least parts of a plurality of elongate strips of the face of the coin.

The strip or strips begin at an edge of the coin, and extend to a predetermined point on the coin. For example, in FIG. 13, the scanned area of the coin comprises a number of strips with width s. One end 70 of each strip is at an edge of the coin, and another end 71 of each strip extends to the diameter of the coin. However, the strip or strips may extend from the edge of the coin to any predetermined location, which is not at an edge of the coin, but which need not necessarily by the diameter.

Preferably, the laser beam scans the strips, or parts of the strips, one after another. In the embodiment shown in FIGS. 13, a number of scan lines, each 63.5 microns wide (i.e the width of the individual pixels in the linear array sensor 3), are used to build up a series of measurements corresponding to the scanned portion of the coin. The process may therefore be likened to a process of integrating segments of area measurements, which are summed together to provide an indication of the characteristic of the coin. Odd shaped coins, such as the United Kingdom 50 p coin which is polygonal, are readily identified by means of measuring surface areas.

Such a system may operate at a rate between 10 Hz and 500 kHz, a typical clock signal being 500 kHz. Improved systems using more up-to-date components may operate between 5 kHz and 2000 kHz, with a preferred clock signal being 2 MHz. A practical embodiment as mentioned above may produce around 39 and 15,000 measurements per second as the coin rolls past the linear array 3. These results are then added together in well-known manner to produce a measure of the total area scanned by the system. It is conceivable that future developments in OEM hardware may result in the components that allow a higher number of measurements per second. These improvements in the speed of components nevertheless would fall within the scope of the present invention, and it is anticipated that future advances in electronics will allow the invention to operate more efficiently.

In the iteration sequence used in the present embodiment, each scan line has an area:

$A=y\delta\theta$ where y=height of strip and $\delta\theta$=width of sensing element Giving:

$$\text{Total area of scanned lines}=y\delta\theta+y_1\delta\theta+y_2\delta\theta+y_3\delta\theta \ldots$$

Figure 13:
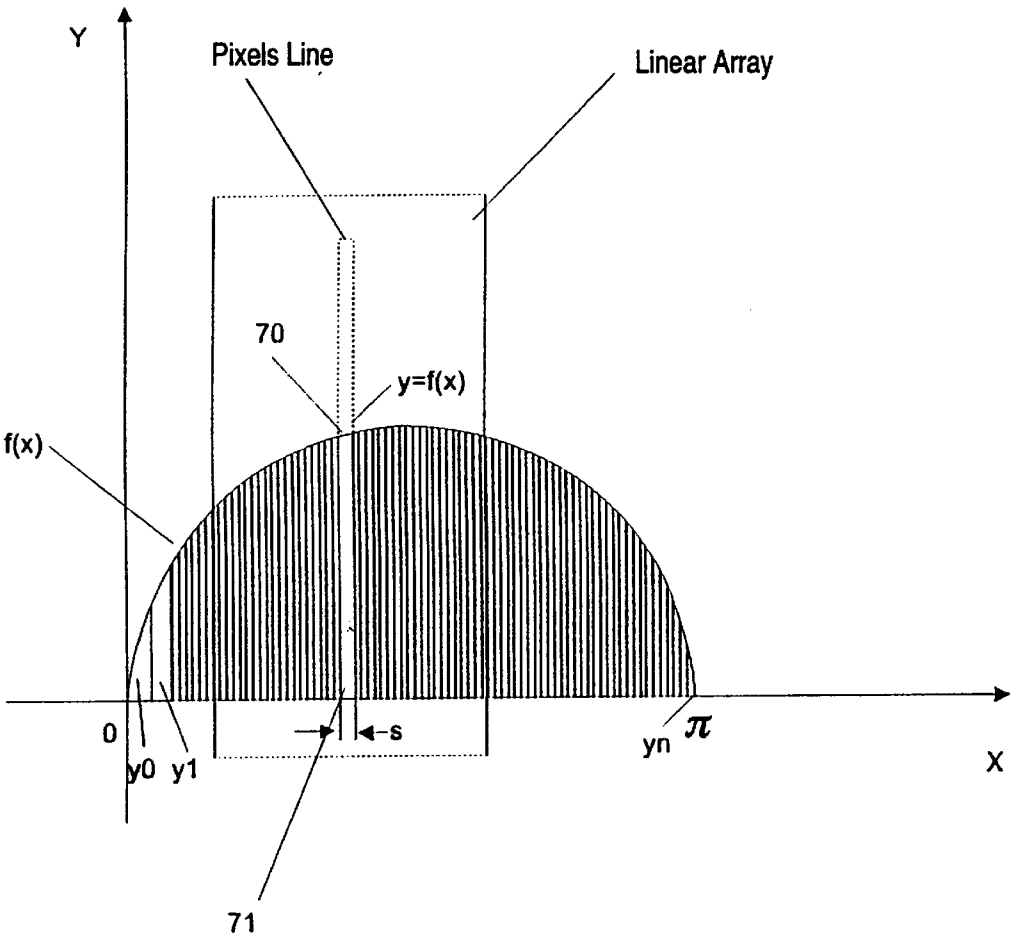
FIG. 13 is a graph, shown on an x y axis, plotting the function for an algorithm which is used for calculations that are performed in an embodiment of the invention.

The above function formulae is represented in a graph illustrated in FIG. 13. In FIG. 13, the height of each strip is referred to as a Y value. Once the Y values have been obtained by scanning the coin, various dimensions of the coin may be calculated by a variety of mathematical algorithms. One such algorithm is known as the Trapezoidal Rule or Simpson's Rule, by the application of the mid-ordinate-rule. Details of this algorithm are given as an example only, and the invention is not limited to any particular mathematical algorithm.

Considering a half cycle of a coin rotation, with periodic function of period $\pi$. The coin is notionally divided in n strips, each having an equal width. The width s of each strip is equal to $\pi/n$. The ordinates are denoted as $y_0, y_1, y_2, \ldots y_{n-1}, y_n$ as shown in FIG. 13.

$$\begin{aligned} A &\cong \frac{1}{2}(y_0+y_1)s+\frac{1}{2}(y_1+y_2)s+\ldots+\frac{1}{2}(y_{n-2}+y_{n-1})s+ \\ &\quad \frac{1}{2}(y_{n-1}+y_n)s \\ &\cong \frac{1}{2}s\{(y_0+y_1)+(y_1+y_2)+\ldots+(y_{n-2}+y_{n-1})+(y_{n-1}+y_n)\} \\ &\cong s\left\{\frac{1}{2}(y_0+y_n)+y_1+y_2+\ldots+y_{n-1}\right\} \end{aligned}$$

now, since. $f(x)=f(x+\pi)$, then. $y_n=y_o \therefore$ $$A=\int_0^n f(x)dx \ldots$$

$$\int_0^n f(x)dx \cong s\{y_0+y_1+y_2+\ldots+y_{n-1}\}$$

where n=number of strips of equal width s=width of each strip

It should be noted that the series within the brackets stops at $y_{n-1}$. The expression $y_n$ is regarded as the first ordinate of the next cycle.

The values of $y_0, y_1, y_2, \ldots$ are available as a given array values at regular intervals. If the function values are not given at regular intervals, a graph may be drawn of y against x, and read off a fresh set of values of y at regular intervals of x, and so forth i.e.

| x (Deg.) | 0 | 30 | 60 | 90 | 120 | 150 | 180 |
|---|---|---|---|---|---|---|---|
| f(x) Array (mm) | 14.38 | 17.84 | 20.72 | 22.45 | 20.72 | 17.84 | 14.38 |

When the coin is scanned at a very high rate, the need for compensation circuitry to compensate for differences in velocity or acceleration of the coin under test is minimised.

Hence, in the present embodiment, the coin testing apparatus is not only able to measure geometric distances, such as radius, diameter and thickness. The high rate of scanning, due in part to the quick response time of the laser beam, enables the coin testing apparatus to measure a range of geometric dimensions iteratively. Each of these measurements is integrated iteratively to provide an area measurement of a surface region of the coin. Thus, the coin are recognised by comparing this area measurement with corresponding area measurements of other known coins.

Using an iterative sequence of integration to obtain surface areas of coins is a far more accurate means of recognising a coin, because it avoids the problem caused by variances of diameters and radii due to edge grooves of the coins. In embodiments of the invention that measure geometric dimensions of the coins, for example the diameter, localised variations due to grooves may influence the overall measurements of the diameter, depending on whether the measurement is taken at a location where a groove is present or not. In contrast, those embodiments which rely on comparisons of surface areas as a basis for identifying the coins, tend to be influenced less by localised differences arising from the present of grooves. The variations due to grooves are taken into account in the measurements of larger areas of the coin's surface.

The use of a laser beam system, coupled with a laser detector that has a multitude of minute laser-detecting pixels, means that extremely fine dimensions may be measured. Consequently, measurements will differ depending on whether the measurement is made proximate to a groove or away from a groove. This difference in measurements means that merely relying on single diameter or radius measurements would introduce an uncertainty in the identification of coins, as it may not be certain whether the measurement was made proximate a groove or away from a groove. When an integrating is made of a range of measurements to provide a surface area measurement, comparisons between coins are made by comparing integrated areas of surface regions. Hence, the localised variations of the dimensions around the grooves do not cause as significant a variation in the total surface area of the integrated region.

With velocity control, the sum of the scanned images can give the real dimensions of the coin measured. This velocity control can be achieved by the use of a slot which stops the coin before the free-fall or the rotation takes place.

Furthermore, the use of area measurements as a basis for identifying coins is particularly advantageous for measuring coins that are not circular, such as polygonal-shaped coins. For such non-circular coins, transverse measurements would yield vastly difference values depending on which part of the coin the measurements are made. However, measurement of surface areas of regions on such coins will provide area measurements which may be consistently used as a basis for comparing these coins with other known coins.

Coin Identification By Counting Grooves

Coins are usually provided with grooves around the circumferential edge, and, in some instances, on the edges of internal holes which are found in coins of some currencies. These grooves provide ridges on the edge of the coin.

Figure 13A:
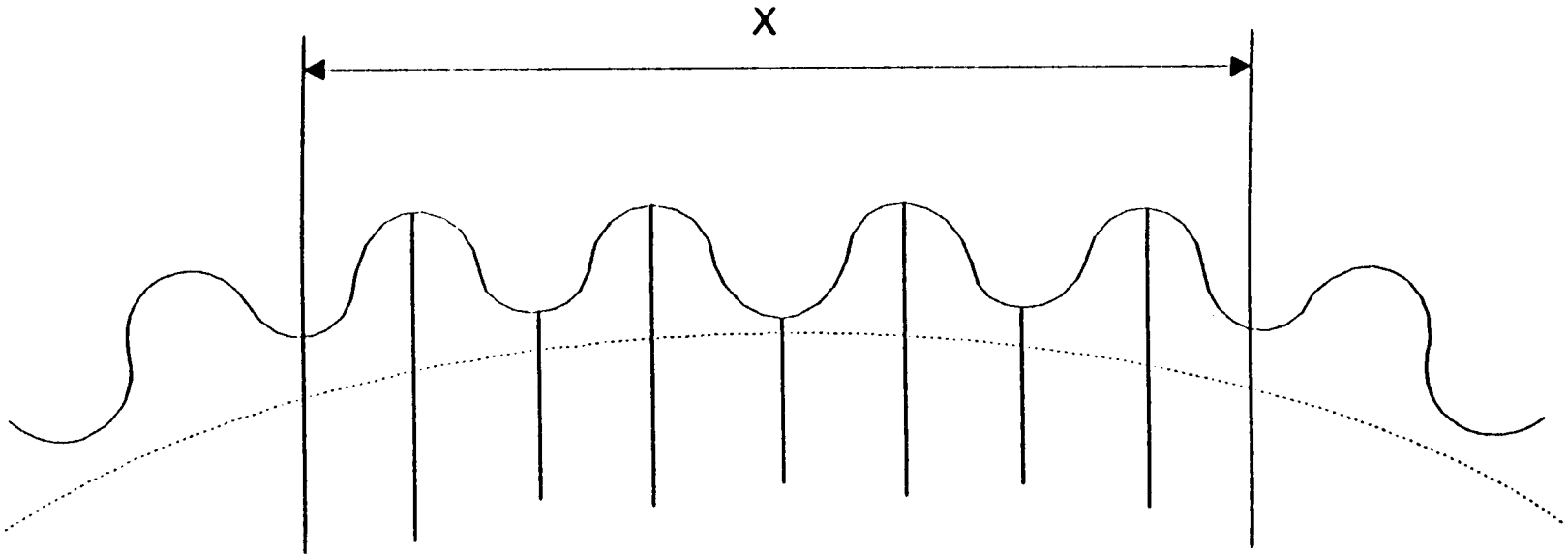
FIG. 13A illustrates an embodiment where the coin is identified with reference to characteristics of grooves in the edge of the coin.

In embodiments where a plurality of strips of a coin are read, the resolution of the sensor array unit 3 is such that the apparatus is able to identify grooves that are milled into the edge of the coin, such as in FIG. 13A. The identification of grooves may be used in conjunction with the identification of other geometrical features already described, or may be used as the sole means of identifying coins. Detection of grooves enables the apparatus to discriminate between difference coins without the need for any further comparisons of, for example, weight or diameter or inductance method being carried out. For example, the cross-sectional area of a typical ridge is generally in the range from 0.01 $mm^2$ to 0.04 $mm^2$, which is approximately three to eleven times the size of each sensing pixel. Thus the area of individual ridges can be clearly resolved by such an array sensor 3.

Even in a rare instance where a pair of coins may have identical diameters, thicknesses, and/or surface areas, it is improbable that these otherwise identical coins would also share the same groove dimensions. Hence, the identification of the characteristics of grooves of a coin is a very accurate means of identifying a large number of coins, even those coins which have very similar geometric dimensions.

It is possible also to count the number of grooves occurring in a pre-determined distance x on the edge of a coin, illustrated in FIG. 13A. An advantage of identifying coins by counting the number of grooves in a predetermined distance is that the apparatus and method would be less influenced by dimensional differences in coins arising from wear and/or damage. Even when the physical dimensions of a coin are changed slightly due to wear, the number of grooves within a predetermined distance will remain constant. Furthermore, if damage to a coin is localised to a small portion, the coin may still be identified, provided that the apparatus reads an undamaged edge of the coin.

In further embodiments, it is possible to produce a digitally defined image of the profile of the coin concerned by analysing the complete set of outputs from the scanning operation. It is then possible to compare this measured image with a number of previously memorised digital images so as to identify the coin concerned. Processing means are provided to compensate for the area of any damaged ridges of the coin. Such compensation can be achieved, for example, by analysing the regular form of the undamaged ridges. The apparatus can be set to reject any coins which vary from the stored image by more than a pre-set percentage. Such variations can be due, for example, to the effects of wear on the coin.

In a further embodiment, the laser radiation detector may comprise a linear sensor array, which consists of eight sections of 128 pixels which forms an array of 1024 X 1 pixels. It is conceivable that wide planes of linear sensor arrays may be used, but such variations of embodiments of the invention will depend on the technological developments in the design of linear arrays.

Embodiments of the invention may be used in a large number of coin or token operated devices, such as product vending machines, telephones, locks, gambling machines, and automated money changing device. It is conceivable that embodiments may be used in a money receiving apparatus, such that the value of the coin may be credited to a credit card or other credit account.

Such coin testing apparatus may be designed to recognise a large number of metallic coins of currencies through the world. Non-metallic coins may also be tested since the invention does not rely on magnetic inductance methods. The apparatus may be also be used for recognising non-currency tokens.

Coins form the world-wide currencies are minted to extremely fine and, most importantly, repeatable tolerances. Some currencies may differ only in the order of several microns. Hence, a particular coin may be recognised by obtaining a measure of a geometric dimension and/or region of the coin, measured at the level of several microns, and then comparing the measure(s) against data records of measures of known coins. This degree of precision means that the present invention is able to distinguish sets of coins that were hitherto not readily distinguishable using earlier apparatus and processes. It also means that an apparatus according to the invention is capable of being used for a larger number of coins. Earlier coin testing apparatus that do not seek to distinguish such fine tolerances, such as in the order of microns, would each tend to be useful only with a limited set of currencies, for example, the coins from a single country where the dimensions from coin to coin would vary substantially. These earlier apparatus are less likely to be used effectively for a large set of coins, where certain coins may differ in dimension by only several microns. For example, in experiments, one apparatus of the present invention was able to successfully distinguish a set of over a hundred difference coins, and the invention is capable of distinguishing much larger sets of different coins.

The embodiments have been advanced by way of example only, and modifications are possible within the scope of the appended claims.

What is claimed is:

1. A method of coin testing, in which a laser beam is directed onto a face of a coin and a laser detector is used to obtain an indication of a dimensional characteristic of the face of the coin, wherein said coin casts a shadow on said laser detector and said laser detector detects where the laser beam is intercepted by the coin and where the laser beam is not intercepted by the coin.

2. A method as claimed in claim 1, wherein the length is determined or detected of at least part of at least one elongate strip of the face of the coin.

3. A method as claimed in claim 2, wherein the lengths are determined or detected of at least parts of a plurality of elongate strips of the face of the coin.

4. A method as claimed in claim 3, wherein the beam scans said strips, or said parts thereof, one after another.

5. A method as claimed in claim 2, wherein said beam has a fan-like shape so as to impinge upon the whole of the or each said strip, or part thereof, simultaneously.

6. A method as claimed in claim 1, wherein said laser detector comprises many side-by-side pixels, each individually capable of detecting laser radiation.

7. A method as claimed in claim 1, wherein the beam is stationary and the coin moves past the beam.

8. A method as claimed in claim 7, wherein the coin rotates as it moves past the beam.

9. A method as claimed in claim 7, wherein the coin moves along a guide (61) as it moves past the beam.

10. A method as claimed in claim 7, wherein the coin is in free fall as it passes the beam.

11. A method as claimed in claim 2, wherein one end of the or each said strip is at an edge of the coin and another end of the strip is at a predetermined location which is not at an edge of the coin.

12. A method as claimed in claim 3, wherein a dimensional characteristic of a groove and/or a ridge on the edge of the coin is determined or detected.

13. A method as claimed in claim 3, wherein the coin has at least one of grooves and ridges at an edge thereof and a number of grooves and/or ridges in a predetermined distance on the edge of the coin are counted.

14. A method as claimed in claim 1, wherein a second laser beam is directed at an edge of the coin and is detected so as to determine a characteristic of the edge and/or thickness of the coin.

15. A method as claimed in claim 14, wherein said second laser beam is derived from the first-mentioned laser beam.

16. A method as claimed in claim 15, wherein said second laser beam is derived from the first-mentioned laser beam by means of a prism which redirects a portion of the first-mentioned laser beam.

17. A method as claimed in claim 1 wherein, at the point of interception of said coin and said laser, said coin is absolutely perpendicular to said laser beam.

18. A method as claimed in claim 1 wherein, at the point of interception of said coin and said laser, said laser beam is substantially in the form of a thin plane of laser radiation.

19. A method as in claim 1, wherein said laser detector is comprised of a CMOS integrated sensor with hold and having a digital output.

20. An apparatus for coin testing, comprising a laser source adapted and arranged to direct a laser beam onto a face of a coin, a laser detector, and a signal-processor adapted and arranged to obtain from an output of the laser detector an indication of a dimensional characteristic of the face of the coin;

wherein said coin casts a shadow on said laser detector and said laser detector is adapted and arranged to detect where the laser is intercepted by the coin and where the laser is not intercepted by the coin.

21. Apparatus as claimed in claim 20, and adapted to determine or detect the length of at least part of at least one elongate strip of the face of the coin.

22. Apparatus as claimed in claim 21, and adapted to determine or detect the lengths of at least parts of a plurality of elongate strips of the face of the coin.

23. Apparatus as claimed in claim 22, wherein the beam is adapted to scan said strips, or said parts thereof, one after another.

24. Apparatus as claimed in claim 21, wherein said beam has a fan-like shape so as to impinge upon the whole of the or each said strip, or part thereof, simultaneously.

25. Apparatus as claimed in claim 20, wherein the laser source and hence the beam are stationary and the apparatus is adapted to cause the coin to move past the beam.

26. Apparatus as claimed in claim 25, and comprising a guide for the coin to move along as it moves past the beam.

27. Apparatus as claimed in claim 25, adapted so that in use, the coin is in free fall as it passes the beam.

28. Apparatus as claimed in claim 21, wherein, in use, one end of the or each said strip is at an edge of the coin and another end of the strip is at a predetermined location which is not at an edge of the coin.

29. An apparatus as claimed in claim 22, wherein a dimensional characteristic of a groove and/or a ridge on the edge of the coin is determined or detected.

30. An apparatus as claimed in claim 22, wherein the coin has at least one of grooves and ridges at an edge thereof and a number of grooves and/or ridges in a predetermined distance on the edge of the coin are counted.

31. Apparatus as claimed in claim 20, and comprising means to direct a second laser beam at an edge of the coin, means to detect where the second beam is intercepted by the coin, and means to determine therefrom a characteristic of the edge an/or thickness of the coin.

32. Apparatus as claimed in claim 31, comprising means to derive said second laser beam from the first-mentioned laser beam.

33. Apparatus as claimed in claim 32, wherein said means to derive said second laser beam from the first-mentioned laser beam comprises a prism which redirects a portion of the first-mentioned laser beam.

34. Apparatus as claimed in claim 20, wherein said laser detector comprises many side-by-side pixels, each individually capable of detecting laser radiation.

35. Apparatus as claimed in claim 20, wherein, at the point of interception of said coin and said laser, said coin is absolutely perpendicular to said laser beam.

36. Apparatus as claimed in claim 20, wherein, at the point of interception of said coin and said laser, said laser beam is substantially in the form of a thin plane of laser radiation.

37. Coin testing apparatus comprising:

a laser source adapted and arranged to direct a laser beam onto a coin;

a laser detector adapted and arranged to detect where the laser is intercepted by the coin and where the laser is not intercepted by the coin;

a coin guide arranged to enable the coin to travel along a specified path along which path the coin is able to intercept a portion of a laser beam passing between the laser source and the laser detector; and a signal-processor adapted and arranged to obtain an output of the laser detector;

wherein the proportion of the laser beam that is intercepted provides at least one measure of a geometric dimension of the coin, the coin being recognisable by comparing said measure of the coin with corresponding measures of a number of known coins.

38. Coin testing apparatus as claimed in claim 37 wherein at least one measure is made of a geometric dimension on the face of said coin and another measure is made of the thickness of said coin in order to compare said measures of the face and thickness with corresponding measures of said number of known coins.

39. Coin testing apparatus as claimed in claim 37, wherein a range of geometric dimensions are measured iteratively to provide an integrated area measurement of a surface region of said coin, said coin being recognisable by comparing said area measurement of said coin with corresponding area measurements of said number of known coins.

40. Coin testing apparatus as claimed in claim 39, wherein a dimensional characteristic of a groove and/or a ridge on the edge of the coin is determined or detected.

41. Coin testing apparatus as claimed in claim 39, wherein the coin has at least one of grooves and ridges at an edge thereof and a number of grooves and/or ridges in a predetermined distance on the edge of the coin are counted.

42. Coin testing apparatus as claimed in claim 37 wherein said measure of a geometric dimension of said coin, and said corresponding measures of said number of known coins, all relate to measurements of coins which are smaller than the diameter or, in the case of irregular-shaped coins, the maximum cross-section of each respective coin.

43. Coin testing apparatus as claimed in claim 37, wherein said laser beam passing between said laser source and said laser detector travels therebetween via a circuitous non-direct route.

44. Coin testing apparatus as claimed in claim 43 wherein said laser beam is directed along said circuitous non-direct rout by one or more of mirrors or prisms.

45. Coin testing apparatus as claimed in claim 37 wherein said path comprises a passageway, having a lower boundary, along which said coin is able to travel through the apparatus whilst supported continuously at its peripheral edge by said lower boundary of said passageway.

46. Coin testing apparatus as claimed in claim 45 wherein said laser source is mounted so as to direct a laser beam from one side to the other of a portion of said passageway, substantially perpendicularly to the main plane of said coin in said passageway, so as to be intercepted by upper regions of said coin as it travels through said portion of said passageway.

47. Coin testing apparatus as claimed in claim 37 wherein said laser detector comprises a linear array of many side-by-side pixels, each individually capable of detecting laser radiation.

48. Coin testing apparatus as claimed in claim 47 wherein said number of coins have respective diameters in a range from a minimum diameter to a maximum diameter, said laser source is mounted so as to direct a laser beam from one side to the other of a portion of said passageway, substantially perpendicularly to the main plane of said coin in said passageway, so as to be intercepted by upper regions of said coin as it travels through said portion of said passageway and said array extends substantially parallel to said main plane, and transversely with respect to the direction of travel said coin along said portion of the passageway, and has a lower end spaced at a first distance from said lower boundary, which first distance is less than the minimum diameter of said number of coins, and an upper end spaced at a second distance from said lower boundary, which second distance is greater than the maximum diameter of said number of coins, said laser detector being operable to produce an output dependent upon the number of said pixels from which said laser beam is blocked, at a plurality of successive sampling instants, by a coin travelling along said portion of the passageway, so that said output can be compared with predetermined reference data records to ascertain which of those records corresponds to said output.

49. Coin testing apparatus as claimed in claim 47, wherein each of said pixels is part of a charge accumulator or charge detector.

50. Coin testing apparatus as claimed in claim 37, wherein said coin travels along said path such that at the point of interception said coin is absolutely perpendicular to said laser beam.

51. Coin testing apparatus as claimed in claim 37, wherein said laser beam that is intercepted by said coin is, at the point of interception, substantially in the form of a thin plane of laser radiation.

52. Coin testing apparatus as claimed in claim 37 wherein said coin testing apparatus is adapted to operate with said coin being a non-currency token.

53. Coin testing apparatus as claimed in claim 37 wherein said apparatus comprises more than one laser source and more than one laser detector.

54. A coin or token-operable device including a coin testing apparatus as claimed in claim 37.

55. A coin or token-operable device comprising a coin testing apparatus as claimed in claim 37.

56. Coin testing apparatus comprising:

a coin guide defining a coin passageway, having a lower boundary, along which a coin can travel through the apparatus whilst supported continuously at its peripheral edge by said lower boundary;

a laser source being mounted for directing a laser beam from one side to the other of a portion of said passageway substantially perpendicularly to the main plane of a coin in the passageway, so as to be intercepted by upper regions of said coin as it travels through said portion of said passageway; and laser detector comprising, at said other side of said portion of the passageway a linear array of laser receiving locations, which array extends substantially parallel to said main plane, and transversely with respect to the direction of travel of the coin along said portion of the passageway, and has a lower end spaced at a first distance from said lower boundary, which first distance is less than a minimum diameter of a number of j coins with which the apparatus is to be used, and an upper end spaced at a second distance from said lower boundary, which second distance is greater than a maximum diameter os said number of coins, said laser detecting means being operable to produce an output dependent upon the number of said laser receiving locations from which said laser beam is blocked, at a plurality of successive sampling instants, by a coin travelling along said portion of the passageway, so that said output can be compared with predetermined reference data records to ascertain which of those records corresponds to said output.

57. A method of recognising a coin comprising the steps of:

i) making a coin travel along a specified path such that said coin intercepts a portion of laser beam passing between a laser radiation source and a laser detector;

ii) measuring the proportion of said laser beam that is intercepted as a means of ascertaining at least one measure of a geometric dimension of said coin, iii) comparing said measure of said coin with the corresponding measure of a number of known coins in order to recognise said coin.

58. A method as claimed in claim 57, wherein said at least one measure is made of a geometric dimension on the face of said coin; said method further comprising the step of ascertaining the measure of the thickness of said coin in order to compare said measures with corresponding measures of said number of known coins.

59. A method as claimed in claim 57, said method further comprising the step of ascertaining the measure of a number of geometric dimension of said coin to provide an integrated area measurement of a surface region of said coin, said coin being recognisable by comparing said area measurement of said coin with the corresponding area measurements of said number of known coins.

60. A method as claimed in claim 59, further comprising the step of determining or detecting a dimensional characteristic of a groove and/or a ridge on the edge of the coin.

61. A method as claimed in claim 59, wherein said coin has at least one of a number of grooves and ridges at an edge thereof and further comprising the step of counting the number of grooves and/or ridges in a predetermined distance on said coin.

62. A method as claimed in claim 57 wherein said laser detector comprises at least one linear array of pixels, each individually capable of detecting laser radiation.

63. A method as claimed in claim 62 wherein said at least one array comprises an array of charge accumulators or charge detectors.

64. A method as claimed in claim 57 wherein said coin is made to travel along said path such that at the point of interception said coin to absolutely perpendicular to said laser beam.

65. A method as claimed in claim 57, wherein the value of said coin is credited to a credit card or a credit account.

66. A method of coin testing in which a light beam is directed onto a coin and a light detector is used to obtain an indication of a dimensional characteristic of the coin, wherein said light detector detects where the light beam is intercepted by the coin and where the light beam is not intercepted by the coin, the lengths are determined or detected of at least parts of a plurality of elongate substantially parallel and abutting strips of the face of the coin and the light beam scans said strips, or said parts thereof, one after another.

* * * * *